US009097008B2

(12) United States Patent
Jung et al.

(10) Patent No.: US 9,097,008 B2
(45) Date of Patent: Aug. 4, 2015

(54) SCREEN BASE

(71) Applicant: FURSYS, INC., Seoul (KR)

(72) Inventors: Su Ik Jung, Seongnam-si (KR); Young Tak Lee, Seoul (KR)

(73) Assignee: Fursys, Inc., Seoul (KR)

( * ) Notice: Subject to any disclaimer, the term of this patent is extended or adjusted under 35 U.S.C. 154(b) by 259 days.

(21) Appl. No.: 13/623,640

(22) Filed: Sep. 20, 2012

(65) Prior Publication Data

US 2013/0068911 A1 Mar. 21, 2013

(30) Foreign Application Priority Data

Sep. 21, 2011 (KR) ..... 10-2011-0095476
Sep. 21, 2011 (KR) ..... 10-2011-0095477

(51) Int. Cl.
*A47F 5/00* (2006.01)
*E04B 2/74* (2006.01)
*A47B 91/02* (2006.01)

(52) U.S. Cl.
CPC ..... *E04B 2/7422* (2013.01); *A47B 91/02* (2013.01)

(58) Field of Classification Search
USPC ..... 248/127, 128, 129, 176.1; 16/19, 45
See application file for complete search history.

(56) References Cited

U.S. PATENT DOCUMENTS

| | | | | |
|---|---|---|---|---|
| 5,330,064 | A * | 7/1994 | Hall | 211/182 |
| 6,505,844 | B2 * | 1/2003 | Hallman et al. | 280/79.7 |
| 7,328,907 | B1 * | 2/2008 | Bileth | 280/79.11 |
| 7,503,337 | B1 * | 3/2009 | Morgan et al. | 135/70 |
| 7,798,455 | B2 * | 9/2010 | Kumazawa | 248/188.2 |
| 8,152,181 | B2 * | 4/2012 | Tomlinson | 280/47.34 |
| 2003/0222186 | A1 * | 12/2003 | Kim | 248/129 |
| 2006/0022096 | A1 * | 2/2006 | Chan et al. | 248/129 |

* cited by examiner

*Primary Examiner* — Steven Marsh
(74) *Attorney, Agent, or Firm* — Nixon Peabody LLP

(57) ABSTRACT

Disclosed herein is a screen base capable of allowing at least one base to be rotatably coupled to a vertical bar which extends to a lower end of a screen, and of adjusting an installation angle of the base. The screen base, which is coupled to the vertical bar extending to the lower end of the screen and supports the screen, includes a base including a body which has a hollow shape and is rotatably coupled to the vertical bar, and an extension portion which is formed to extend outward of the vertical bar from the body; and a fixing unit to fix the body with respect to the vertical bar.

8 Claims, 19 Drawing Sheets

SCREEN BASE

CROSS-REFERENCE(S) TO RELATED APPLICATIONS

This application claims priority to Korean Patent Application Nos. 10-2011-0095476 and 10-2011-0095477, filed on Sep. 21, 2011 which are incorporated herein by reference in their entirety.

BACKGROUND OF THE INVENTION

1. Field of the Invention

Exemplary embodiments of the present invention relate to a screen base for supporting a screen, and more particularly, to a screen base capable of allowing at least one base to be rotatably coupled to a vertical bar which extends to a lower end of a screen, and of adjusting an installation angle of the base.

2. Description of the Related Art

In general, a screen device is to be installed for the purpose of blocking other people's eyes, and includes a frame defining an external appearance, a screen to block other people's eyes, and a base which is provided at a lower end of the frame and supports the screen so that the screen does not fall down.

Particularly, a partition, which is installed in a work space such as an office, is a kind of such a screen device. The screen device installs one screen or connects a plurality of screens to each other to complexly install the screens, thereby partitioning a predetermined space into multiple regions.

Consequently, it may be possible to protect privacy of the members in the office and improve concentration of business. In addition, spaces between respective departments are blocked from the outside to allow creative work to be carried out.

Meanwhile, the typical screen has a thinner thickness than a width. Thus, as also disclosed in Korean Unexamined Utility Model Application Publication No. 20-2009-0005236, published on Jun. 1, 2009 (Patent Document 1), the base, which supports the screen so that the screen does not fall down in a forward or backward direction, is formed at the lower end of the screen to be elongated in forward and backward directions.

Accordingly, there is a problem in that an office floor is kept in poor order after installation of the screen device due to the base protruding from the lower end of the screen. In particular, when the base protrudes toward a passageway, this causes inconvenience during passing of people.

Moreover, this also limits an installation space of the screen. For example, in a case of installing the screen to be adjacent to a wall, the screen is not installed to come into tight contact with the wall, thereby resulting in generation of an unutilized space between the screen and the wall due to the base protruding toward the wall.

SUMMARY OF THE INVENTION

The present invention has been made in view of the above problems, and it is an object of the present invention to provide a screen base including at least one base which is rotatably coupled to a vertical bar extending to a lower end of a screen, and capable of easily adjusting an installation angle of the base.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a screen base, which is coupled to a vertical bar extending to a lower end of a screen and supports the screen, includes a base including a body which has a hollow shape and is rotatably coupled to the vertical bar, and an extension portion which is formed to extend outward of the vertical bar from the body; and a fixing unit to fix the body with respect to the vertical bar.

The extension portion may be constituted of at least two extension portions which are formed to extend outward of the vertical bar from the body and to be spaced apart from each other by a predetermined angle.

The fixing unit may be a set screw which passes through and is inserted into one side of an outer peripheral surface of the body.

The hollowness of the body may be provided with a bushing, and a rotational friction force of the body may be adjusted with respect to the vertical bar by the set screw which passes through the body and presses the bushing.

In accordance with another aspect of the present invention, the base may include a first base including a first body which has a hollow shape and is rotatably coupled to the vertical bar, and a first extension portion which is formed to extend outward of the vertical bar from the first body; and a second base including a second body which has a hollow shape and is coupled to a lower end of the first body, and a second extension portion which extends outward of the vertical bar from the second body and is formed at a height corresponding to the first extension portion.

The hollowness of the first or second body may be provided with a bushing, the fixing unit may be a set screw which passes through and is inserted into one side of an outer peripheral surface of the first or second body, and a rotational friction force of the first or second body may be adjusted with respect to the vertical bar by the set screw.

The first body may be protrusively formed, at one side thereof, with a first fastening portion to fasten the fixing unit; the second body may be protrusively formed, at one side thereof, with a second fastening portion; and the first and second fastening portions may allow a rotational angle of the second base relative to the first base to be limited.

In accordance with another aspect of the present invention, the fixing unit may include a base pin of which one end is inserted into a fixing hole of the vertical bar; and a switch member which is slidable in a longitudinal direction of the first or second base, the other end of the base pin being coupled to one side of the switch member.

In accordance with a further aspect of the present invention, the fixing unit may include a base pin of which one end is inserted into a fixing hole of the vertical bar; a pin connector which is slidable in a longitudinal direction of the first or second base, the other end of the base pin being coupled to one side of the pin connector; a foot switch member which is hinge-coupled to an upper side of the first or second base so as to be rotatable in an upward and downward direction; and a wire cable to connect a lower end of the foot switch member and the other side of the pin connector.

The fixing unit may further include an elastic member to elastically support the base pin toward the vertical bar.

The second body may be formed, at one side thereof, with a through hole while being formed, at the other end thereof, with a cutting groove which is cut by a predetermined angle in a circumferential direction thereof, and a rotational angle of the first base relative to the second base may be limited by a base pin of the first base which is inserted into the cutting groove.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
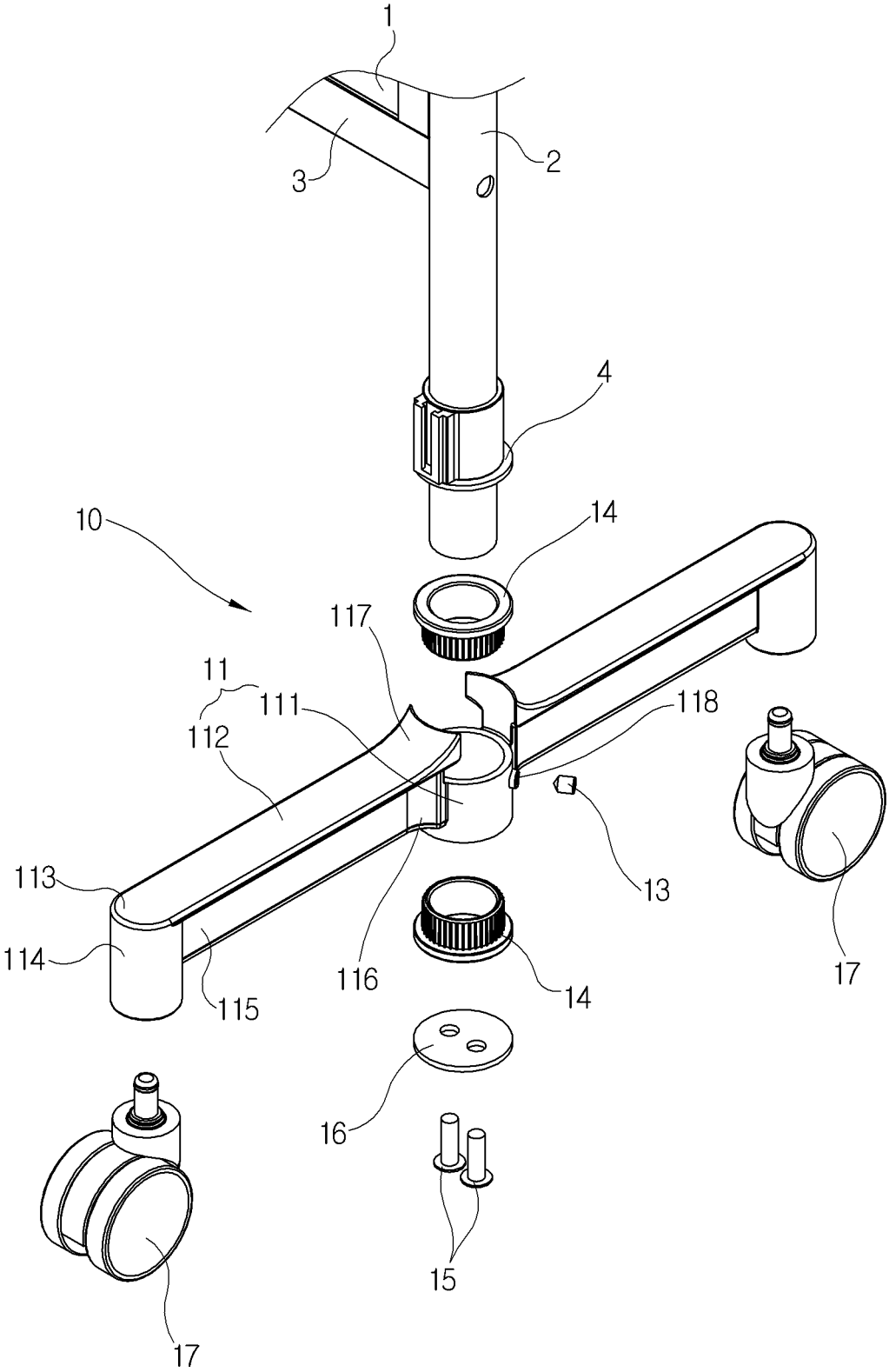
FIG. 1 is an exploded perspective view of a screen base in accordance with a first embodiment of the present invention.

Hereinafter, a screen base according to exemplary embodiments of the present invention will be described in more detail with reference to the accompanying drawings. In the description, the thickness of each line or the size of each component illustrated in the drawings may be exaggerated for convenience of description and clarity.

The terminology used in the present embodiments is to be defined in considering the function of the component of the present invention only and may be varied depending on the intention of a user or operator or the practice. Therefore, the definition of this terminology will be given based on the contents throughout the embodiments set forth herein.

In addition, the following embodiments are for the purpose of describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

First Embodiment

FIG. 1 is an exploded perspective view of a screen base in accordance with a first embodiment of the present invention.

As shown in FIG. 1, the screen base, which is designated by reference numeral 10, according to the first embodiment of the present invention is rotatably coupled to a vertical bar 2 which extends to a lower end of a screen 1, and supports the screen 1 so that the screen 1 does not fall down.

In more detail, the screen base 10 according to the first embodiment of the present invention includes a base 11 which is rotatably coupled to a lower end portion of the vertical bar 2, and a fixing unit to fix the base 11 with respect to the vertical bar 2.

Here, the base 11 includes a hollow cylindrical body 111 for inserting the vertical bar 2, and a pair of extension portions 112 which faces each other about the body 111 and respectively extends outward of the vertical bar 2.

Also, the fixing unit may be constituted of a set screw 13 which passes through one side of an outer peripheral surface of the body 111 and is inserted into the body 111.

That is, the body 111 may be rotated along an outer peripheral surface of the vertical bar 2 in a circumferential direction thereof, and the pair of extension portions 112 is fixed, along with the body 111, to the vertical bar 2 by the set screw 13 which passes through and is inserted into the body 111.

Accordingly, in a state of inserting the body of the screen base 10 into the outer peripheral surface of the vertical bar 2, a user may rotate the screen base 10 so that the pair of extension portions 112 makes a proper angle with respect to the vertical bar 2, and then fix a position of the screen base 10 by inserting the set screw 13 into the body 111.

The vertical bar 2 extends to a lower end of a screen frame 3 so that the screen 1 is spaced apart from the ground. The vertical bar 2 may have a circular or polygonal cross-section shape, and have a hollow pipe shape in order to attain a reduction in materials and weight.

The body 111 has a hollow cylindrical shape, and the above-mentioned vertical bar 2 is rotatably coupled to the hollowness of the body 111. In this case, in order for the vertical bar 2 to be smoothly rotated relative to the body 111, the hollowness of the body 111 may be provided, at respective upper and lower ends thereof, with bushings 14 which are made of, for example, a plastic material such as polyacetal (POM), and the lower end of the vertical bar 2 may be coupled to a lower end cover 16 using fasteners 15 such as a bolt.

In the screen base 10 according to the first embodiment of the present invention, the body 111 and the pair of extension portions 112 are integrally formed, and the pair of extension portions 112 is formed to face each other about the body 111. That is, the pair of extension portions 112 is formed to extend from the body 111 in respective opposite directions, thereby being made at an angle of 180° therebetween.

In this case, each of the extension portions 112 has a predetermined width, and is formed in a plate shape having a longer length than the width. The extension portion 112 has an end formed in a rounded shape, and the rounded end of the extension portion 112 is formed with a round portion 113 having an arc shape.

The round portion 113 is formed, at a lower end thereof, with a cylindrical support portion 114 which is formed to extend downwards from the lower end thereof. The support portion 114 may be directly supported on the ground, or be provided, at a lower end thereof, with a caster 17 as shown in FIG. 1 so that the screen 1 is moved along with the screen base 10.

Furthermore, the extension portion 112 is formed, at a lower end thereof, with a reinforced portion 115 in a downward direction thereof. The reinforced portion 115 is formed along a longitudinal direction of the extension portion 112. The reinforced portion 115 is connected, at one end thereof, to one side of the body 111 while being connected, at the other end thereof, to one side of the support portion 114. In this case, one end of the reinforced portion 115 abutting on the body 111 may be formed with a flange portion 116 which has an increasing thickness as going toward the body 111, in order to reinforce rigidity of the extension portion 112.

In addition, the extension portion 112 is formed, at an upper side thereof adjacent to the body 111, with a connection portion 117 which is inclined upwards toward the body 111. The connection portion 117 has a curved surface at an upper side thereof so as to enclose the outer peripheral surface of the vertical bar 2 together with the flange portion 116 during the assembly of the vertical bar 2 and the body 111, thereby providing an aesthetically external appearance.

The outer peripheral surface of the body 111 is formed with at least one through hole 118. The set screw 13 is inserted into the through hole 118, and is tightly supported, at a tip thereof, on an outer peripheral surface of each bushing 14 within the hollowness of the body.

Accordingly, a clearance between the vertical bar 2 and the bushing 14 may be adjusted by screwing or unscrewing the set screw 13, thereby enabling the adjustment of the rotational friction force of the screen base 10 with respect to the vertical bar 2.

As an alternative example, the vertical bar 2 may also be formed with a fixing hole (not shown) corresponding to the through hole 118 of the body 111 during the assembly of the vertical bar 2 and the screen base 10, such that the tip of the set screw 13 is inserted into or thread-coupled to the fixing hole so as to fix the position of the screen base 10. In addition, the set screw 13 may be constituted of, for example, a wing bolt to facilitate the grasp and operation thereof.

Meanwhile, the outer peripheral surface of the vertical bar 2 is protrusively formed with a catch part 4 for serving to limit an insertion distance of the vertical bar 2, and a lower end edge of the catch part 4 is caught and supported by an upper end edge of the bushing 14.

Figure 2:
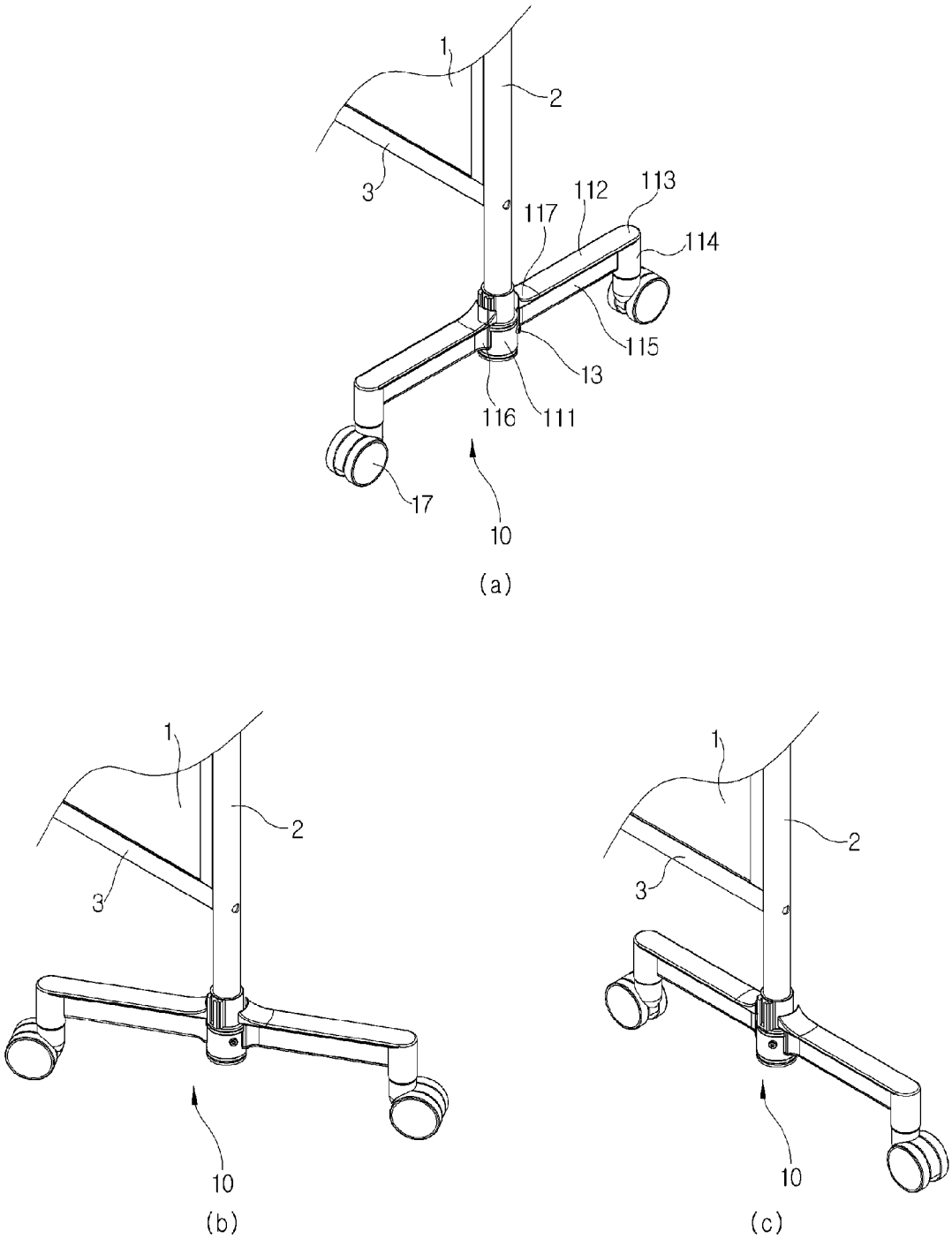
FIG. 2 is an operation state view of the screen base in accordance with the first embodiment of the present invention.
Figure 3:
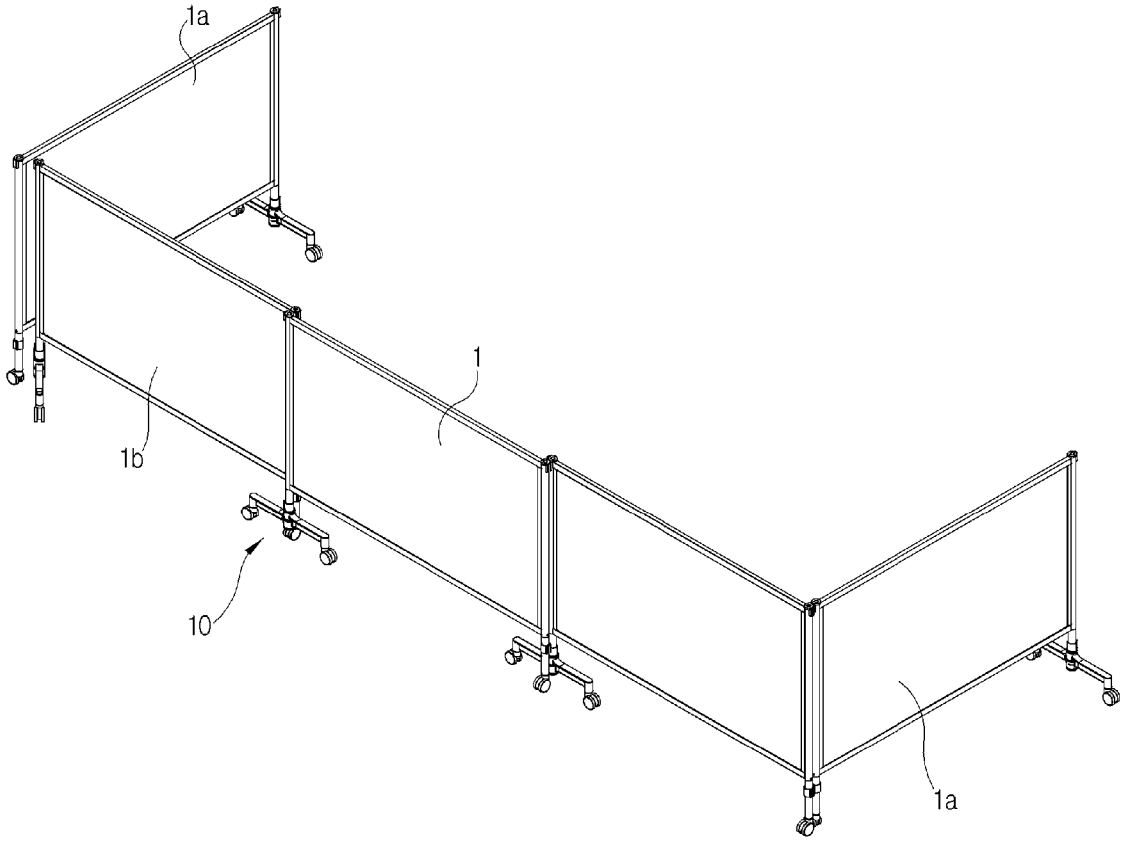
FIG. 3 is a use state view illustrating an installation example of the screen base in accordance with the first embodiment of the present invention.

FIG. 2 is an operation state view of the screen base in accordance with the first embodiment of the present invention, and FIG. 3 is a use state view illustrating an installation example of the screen base in accordance with the first embodiment of the present invention.

As shown in FIG. 2(*a*), a user may arrange the screen base 10 so that the screen base 10 makes a right angle with respect to the screen 1. In this case, the bushing 14 comes into tight contact with the vertical bar 2 by the set screw 13 which passes through and inserted into the body 111 to allow an installation angle of the screen base 10 to be fixed.

As shown in FIG. 2(*b*), in a state of changing the installation angle of the screen base 10, a user may rotate the screen base 10 at a proper angle by unscrewing the set screw 13, and then fix the screen base 10 at a desired position by screwing the set screw 13.

Similarly, FIG. 2(*c*) illustrates an example in which the screen base 10 is rotated to be parallel with the screen 1 and is then fixed.

FIG. 3 illustrates an example of partitioning a space by connecting and installing a plurality of the screens 1. In the example of FIG. 3, the screen base 10 according to the first embodiment of the present invention is provided at the lower end of one side of each screen 1, whereas the caster 17 is coupled to the lower end of the vertical bar 2 without the screen base 10 at the lower end of the other side of the screen 1.

In this case, the screen base 10 may be installed in parallel with the screen 1 at the outside, namely, a portion corresponding to a passageway, of the space partitioned by the screen 1 so that the screen base 10 does not protrude to the passageway. The screen base 10 is installed at a lower end of each screen 1*a* which is arranged perpendicular to the passageway so that so that the screen base 10 makes a right angle with to the screen 1*a*. The screen base 10 is installed at a lower end of a screen 1*b* adjacent to the screen 1*a* so as to be rotated at an angle of 45° with respect to the screen 1*b*. In accordance with such a configuration, the connected entire screens 1 are supported so as not to fall down.

In addition, although the screen base 10 has been illustrated as being provided at only the lower end of one side of each screen 1 in the example of FIG. 3, all lower ends of both sides of the screen 1 may also be provided with the screen base 10 according to the first embodiment of the present invention.

Second Embodiment

Figure 4:
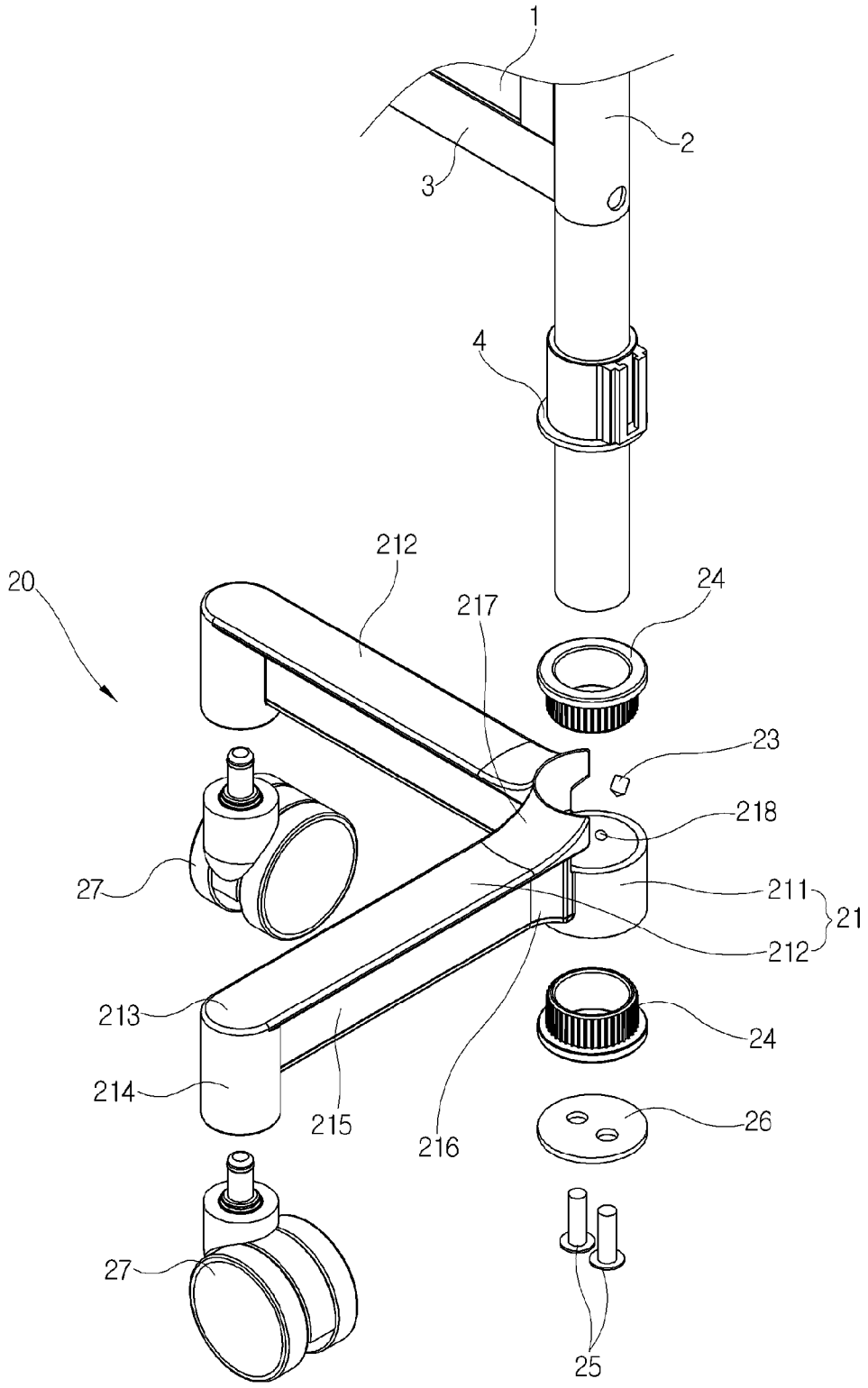
FIG. 4 is an exploded perspective view of a screen base in accordance with a second embodiment of the present invention.
Figure 5:
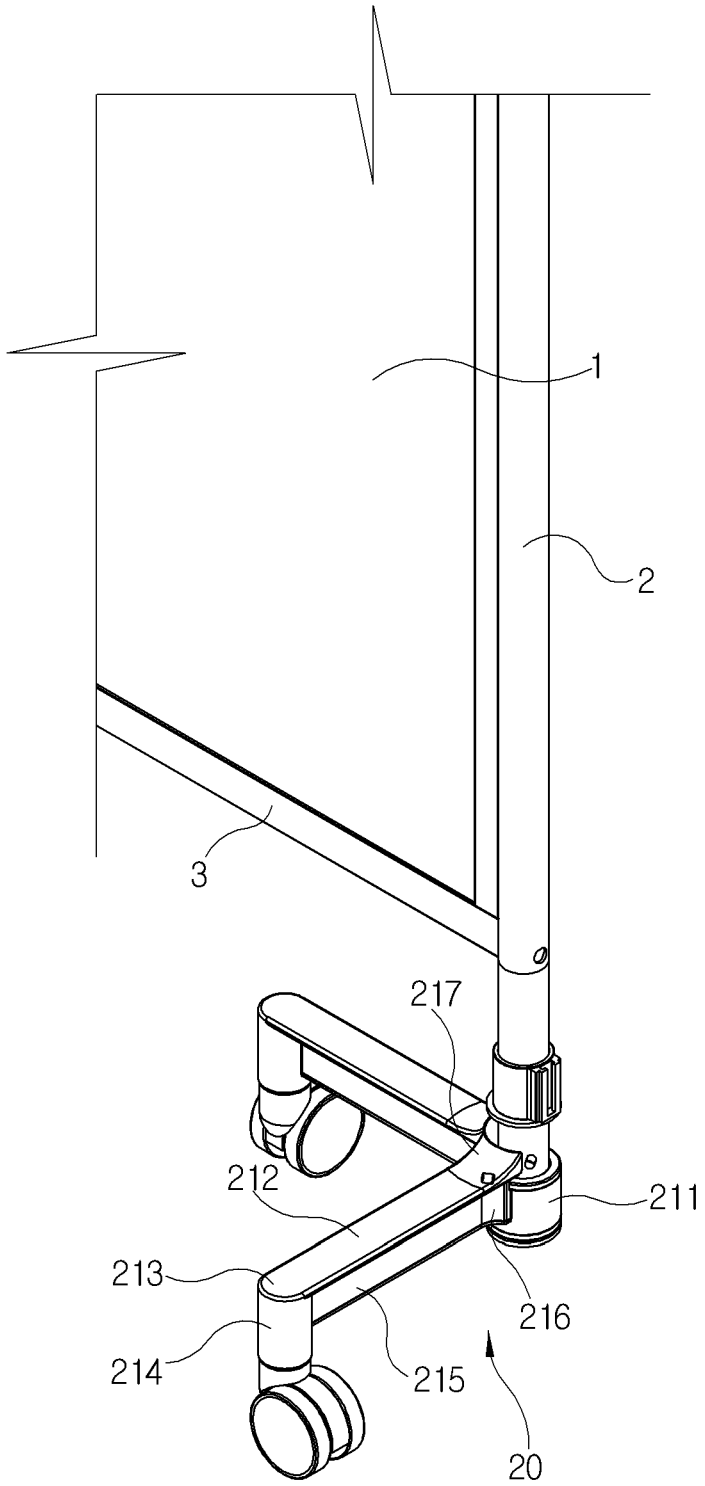
FIG. 5 is a coupled view of FIG. 4.

FIG. 4 is an exploded perspective view of a screen base in accordance with a second embodiment of the present invention, and FIG. 5 is a coupled view of FIG. 4.

The screen base, which is designated by reference numeral 20, according to the second embodiment of the present invention is entirely similar to the screen base of the above-mentioned first embodiment. However, there is a difference in that a pair of extension portions 212 is made at an angle of 90° therebetween and connection portions 217, which are formed to extend from the respective extension portions 212 toward a body 211, are joined to each other so as to be integrally formed. Therefore, no description with respect to configurations which repeat or are similar to the above-mentioned first embodiment will be given in more detail.

The screen base 20 according to the second embodiment of the present invention includes a base 21 which is rotatably coupled to the lower end portion of the vertical bar 2, and a fixing unit to fix the base 21 with respect to the vertical bar 2.

Here, the base 21 includes the hollow body 211 for coupling the vertical bar 2, and the pair of extension portions 212 which is integrally formed with the body 211 while being made at an angle of 90° therebetween.

In this case, each of the extension portions 212 is formed, at one end thereof, with a round portion 213 having an arc shape. The round portion 213 is formed, at a lower end thereof, with a cylindrical support portion 214 which extends downwards from the lower end thereof. The extension portion 212 is formed, at a lower end thereof, with a reinforced portion 215 along a longitudinal direction thereof. The support portion 214 is coupled with a caster 27 as occasion demands.

The reinforced portion 215 is formed, at one end thereof, with a flange portion 216 connected to an outer peripheral surface of the body 211 while being connected, at the other end thereof, to one side of the support portion 214, thereby reinforcing rigidity of the extension portion 212.

In addition, the extension portions 212 are formed, at respective upper sides thereof adjacent to the body 211, with the connection portions 217 which have a curved surface to be inclined upwards toward the body 211. Each of the connection portions 217 encloses the outer peripheral surface of the vertical bar 2 together with the flange portion 216 during the assembly of the vertical bar 2 and the body 211, thereby providing an aesthetically external appearance.

In addition, the hollowness of the body 211 is provided, at respective upper and lower ends thereof, with bushings 24 which are made of, for example, a plastic material such as polyacetal (POM) in order for the vertical bar 2 to be smoothly rotated relative to the body 211. The lower end of the vertical bar 2 is coupled to a lower end cover 26 using fasteners 25 such as a bolt.

Thus, the screen base 20 according to the second embodiment of the present invention may be rotated about the vertical bar 2. A user may rotate the screen base 20 at a proper angle and then insert a set screw 23 via a through hole 218 of the body 211, thereby fixing an installation position of the screen base 20.

In this case, the set screw 23 is tightly supported, at a tip thereof, on an outer peripheral surface of each bushing 24, and a clearance between the vertical bar 2 and the bushing 24 is adjusted by screwing or unscrewing the set screw 23, thereby enabling the adjustment of the rotational friction force between the screen base 20 and the vertical bar 2. As an alternative example, the tip of the set screw 23 may be inserted into or thread-coupled to a fixing hole (not shown) of the vertical bar 2 so as to fix a rotational angle of the screen base 20 with respect to the vertical bar 2, and this is similar to the above-mentioned configuration.

Meanwhile, one side of the outer peripheral surface of the vertical bar 2 which extends to the lower end of the screen frame 3 is protrusively formed with the catch part 4 for serving to limit the insertion distance of the vertical bar 2, and the lower end edge of the catch part 4 is caught and supported by an upper end edge of the bushing 24.

Figure 6:
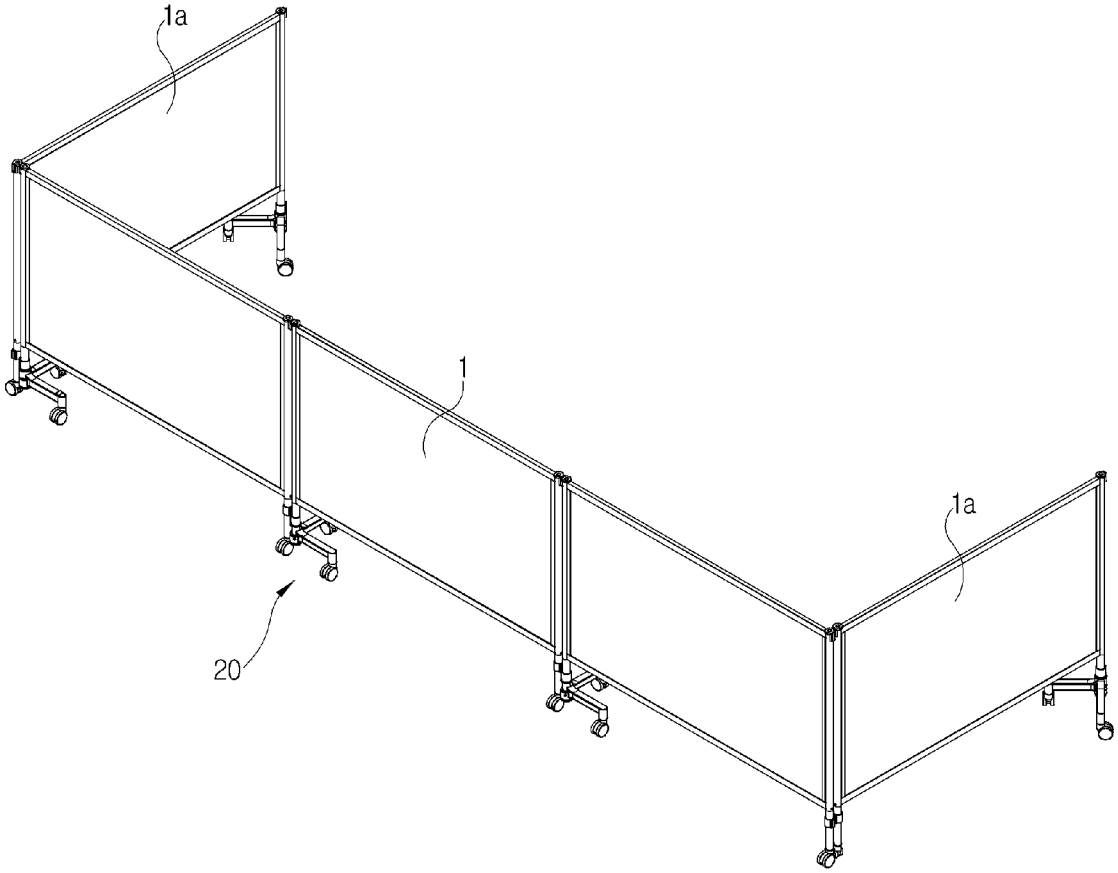
FIG. 6 is a use state view illustrating an installation example of the screen base in accordance with the second embodiment of the present invention.

FIG. 6 is a use state view illustrating an installation example of the screen base in accordance with the second embodiment of the present invention.

FIG. 6 illustrates an example of partitioning a space by connecting and installing a plurality of the screens 1. In the example of FIG. 6, the screen base 20 according to the second embodiment of the present invention is provided at the lower end of one side of each screen 1, whereas the caster 27 is coupled to the lower end of the vertical bar 2 without the screen base 20 at the lower end of the other side of the screen 1.

In this case, in order for the screen base 20 not to protrude to the outside, namely, a portion corresponding to a passageway, of the space partitioned by the screen 1, the screen base 20 may be installed so that one extension portion 212 is located in parallel with the screen 1 and the other extension portion 212 protrudes to the inside of the space. At a lower end of each screen 1*a* which is arranged perpendicular to the passageway, the screen 1*a* is located between the pair of extension portions 212, such that the connected entire screens 1 are supported so as not to fall down.

Meanwhile, although the screen base 20 has been illustrated as being provided at only the lower end of one side of each screen 1 in the example of FIG. 6, both lower ends of the screen 1 may also be provided with the screen base 20 according to the second embodiment of the present invention.

In addition, the present invention may be utilized in such a manner that a portion of the screens 1 is coupled with the screen base 10 according to the first embodiment and the other portion is coupled with the screen base 20 according to the second embodiment.

Third Embodiment

Figure 7:
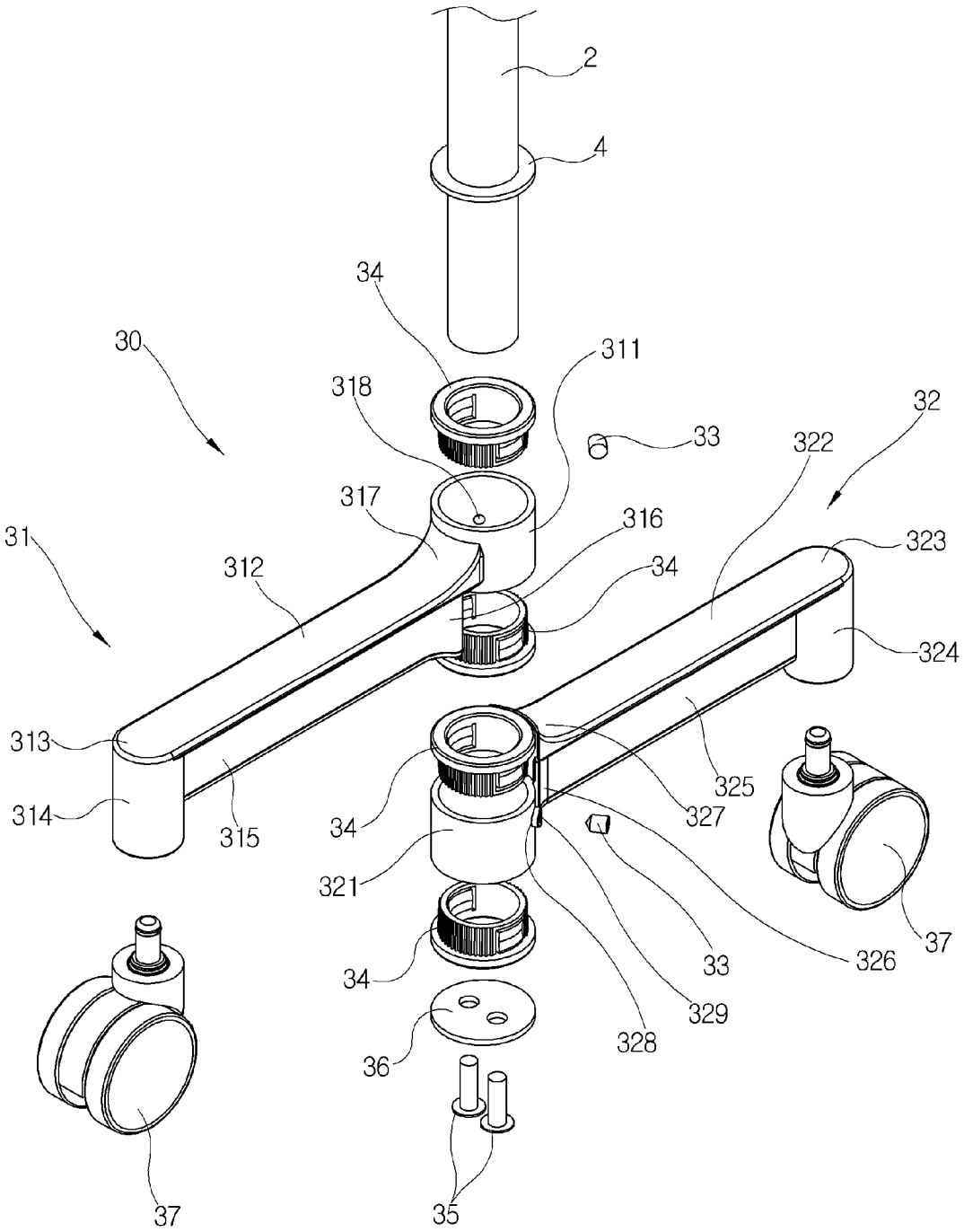
FIG. 7 is an exploded perspective view of a screen base in accordance with a third embodiment of the present invention.

FIG. 7 is an exploded perspective view of a screen base in accordance with a third embodiment of the present invention.

The screen base, which is designated by reference numeral 30, according to the third embodiment of the present invention is entirely similar to the screen bases of the above-mentioned first and second embodiments. However, there is a difference in that a pair of bases 31 and 32 is rotatably coupled relative to each other. Therefore, no description with respect to configurations which repeat or are similar to the above-mentioned embodiments will be given in more detail.

In the screen base 30 according to the third embodiment of the present invention, the first base 31 and the second base 32 are rotatably coupled relative to the vertical bar 2.

Here, the first base 31 includes a first hollow cylindrical body 311 for inserting the vertical bar 2, and a first extension portion 312 which extends outward of the vertical bar 2 from one side of the first body 311.

In this case, the first body 311 may be rotated along the outer peripheral surface of the vertical bar 2 in the circumferential direction thereof. The first extension portion 312 is fixed, along with the first body 311, to the vertical bar 2 by a set screw 33 which passes through and is inserted into the first body 311.

The second base 32 includes a second hollow cylindrical body 321 for inserting the vertical bar 2, and a second extension portion 322 which extends outward of the vertical bar 2 from one side of the second body 321.

In this case, the second body 321 may be rotated along the outer peripheral surface of the vertical bar 2 in the circumferential direction thereof. The second extension portion 322 is fixed, along with the second body 321, to the vertical bar 2 by another set screw 33 which passes through and is inserted into the second body 321.

During the assembly of the first and second bases 31 and 32 to the vertical bar 2, the second body 321 is located at a lower end of the first body 311 and the first and second extension portions 312 and 322 are located at the same height as each other. For this reason, the first extension portion 312 may extend outward of the vertical bar 2 from one side of the lower end of the first body 311, and the second extension portion 322 may extend outward of the vertical bar 2 from one side of an upper end of the second body 321.

Accordingly, in a state of inserting the first body 311 of the first base 31 and the second body 321 of the second base 32 into the outer peripheral surface of the vertical bar 2, a user rotates the first base 31 so that the first base 31 makes a proper angle with respect to the vertical bar 2, and then fixes a position of the first base 31 by inserting the set screw 33 into the first body 311. Subsequently, a user rotates the second base 32 at a proper angle, and then fixes a position of the second base 32 by inserting another set screw 33 into the second body 321.

In this case, the vertical bar 2 extends to the lower end of the screen frame 3 (see FIG. 8) so that the screen 1 is spaced apart from the ground. The vertical bar 2 may have a circular or polygonal cross-section shape, and have a hollow pipe shape in order to attain a reduction in materials and weight.

The first and second bodies 311 and 321 have a hollow cylindrical shape, and the above-mentioned vertical bar 2 is rotatably coupled to the hollowness of each of the first and second bodies 311 and 321. In this case, in order for the vertical bar 2 and the first and second bodies 311 and 321 to be smoothly rotated relative to one another, the hollowness of each of the first and second bodies 311 and 321 may be provided, at respective upper and lower ends thereof, with bushings 34 which are made of, for example, a plastic material such as polyacetal (POM), and the lower end of the vertical bar 2 may be coupled to a lower end cover 36 using fasteners 35 such as a bolt.

In this case, the first and second extension portions 312 and 322 have a predetermined width, and are formed in a plate shape having a longer length than the width. The first and second extension portions 312 and 322 respectively have ends formed in a rounded shape, and the rounded ends of the first and second extension portions 312 and 322 are respectively formed with a first round portion 313 and a second round portion 323 which have an arc shape.

The first and second round portions 313 and 323 are formed, at respective lower ends thereof, with a first cylindrical support portion 314 and a second cylindrical support portion 324 which are formed to extend downwards from the lower ends thereof. The first and second support portions 314 and 324 may be directly supported on the ground, or be provided, at respective lower ends thereof, with casters 37 as shown in FIG. 7 so that the screen 1 is movable.

Furthermore, the first and second extension portions 312 and 322 are formed, at lower ends thereof, with first and second reinforced portions 315 and 325 in downward directions thereof, respectively. The first and second reinforced portions 315 and 325 are respectively formed along longitudinal directions of the first and second extension portions 312 and 322. Each of the first and second reinforced portions 315 and 325 is connected, at one end thereof, to one side of each of the first and second bodies 311 and 321 while being connected, at the other end thereof, to one side of each of the first and second support portions 314 and 324. In this case, one end of the associated first or second reinforced portion 315 or 325 abutting on each of the first and second bodies 311 and 321 may be formed with an associated first or second flange portion 316 or 326 which has an increasing thickness as going toward each first or second body 311 or 321, in order to reinforce rigidity of each of the first and second extension portions 312 and 322.

In addition, the first and second extension portions 312 and 322 are formed, at upper sides thereof adjacent to the first and second bodies 311 and 321, with first and second connection portions 317 and 327 which are inclined upwards toward the first and second bodies 311 and 321, respectively. Each of the first and second connection portions 317 and 327 has a curved surface at an upper side thereof, thereby providing an aesthetically external appearance.

The outer peripheral surfaces of the first and second bodies 311 and 321 are formed with first and second through holes 318 and 328, respectively. The set screws 33 are respectively inserted into the first and second through holes 318 and 328, and a tip of each of the set screws 33 is tightly supported on an outer peripheral surface of each bushing 34 within the hollowness of each of the first and second bodies 311 and 321.

Accordingly, a clearance between the vertical bar 2 and the bushing 34 may be adjusted by screwing or unscrewing each set screw 33, thereby enabling the adjustment of the rotational friction force of each first or second base 31 or 32 with respect to the vertical bar 2.

As an alternative example, the vertical bar 2 may also be formed with fixing holes (not shown) corresponding to the first and second through holes 318 and 328 of the respective first and second bodies 311 and 321 during the assembly of the vertical bar 2 and the first and second bases 31 and 32, such that the tips of the set screws 33 are inserted into or thread-coupled to the fixing holes so as to fix the positions of the first and second bases 31 and 32, respectively. In addition, each set screw 33 may be constituted of, for example, a wing bolt to facilitate the grasp and operation thereof.

Meanwhile, one side of the outer peripheral surface of the vertical bar 2 is protrusively formed with the catch part 4 for serving to limit the insertion distance of the vertical bar 2, and the lower end edge of the catch part 4 is caught and supported by an upper end edge of the bushing 34.

Figure 8:
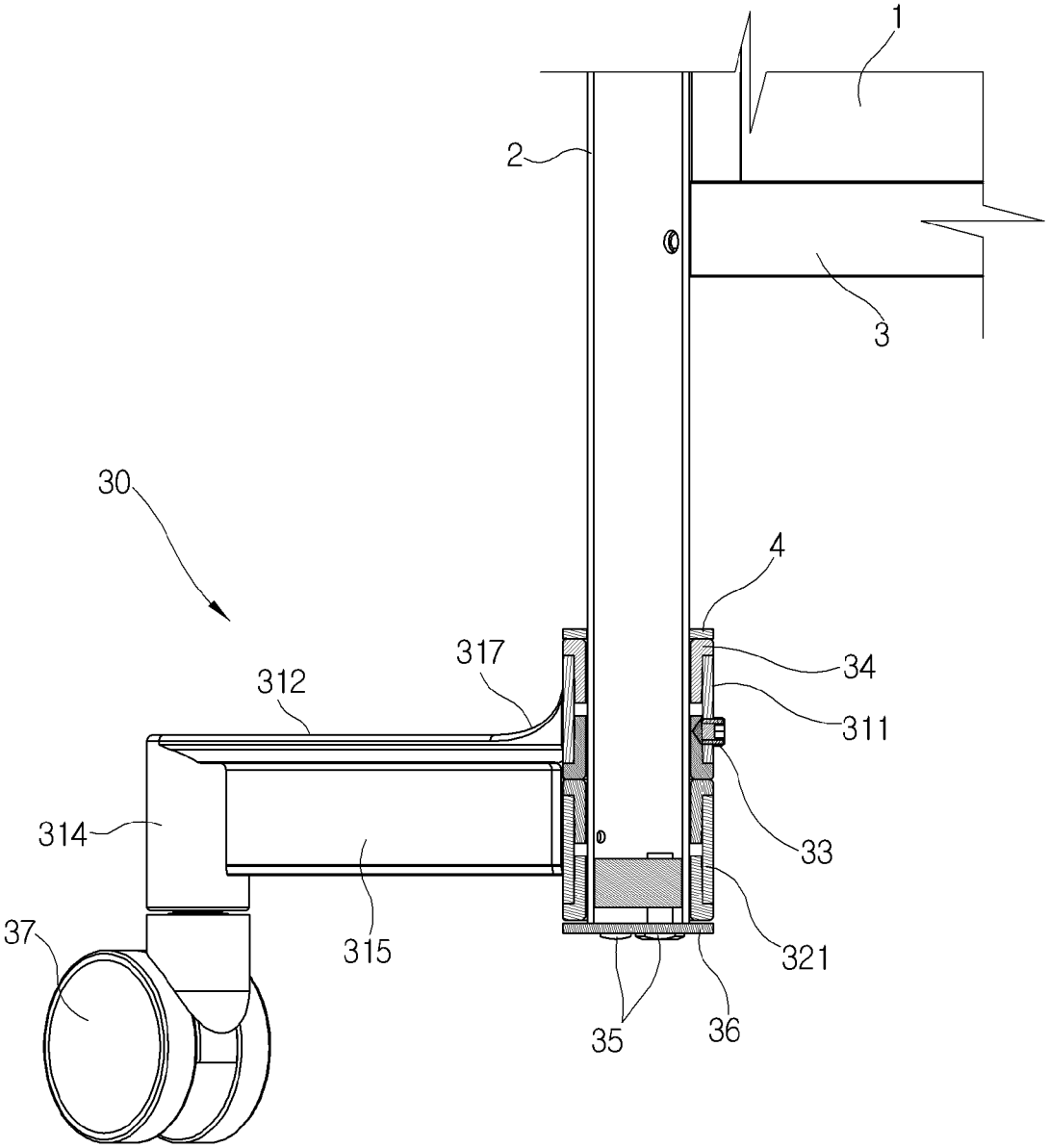
FIG. 8 is a coupled cross-sectional view of FIG. 7.
Figure 9:
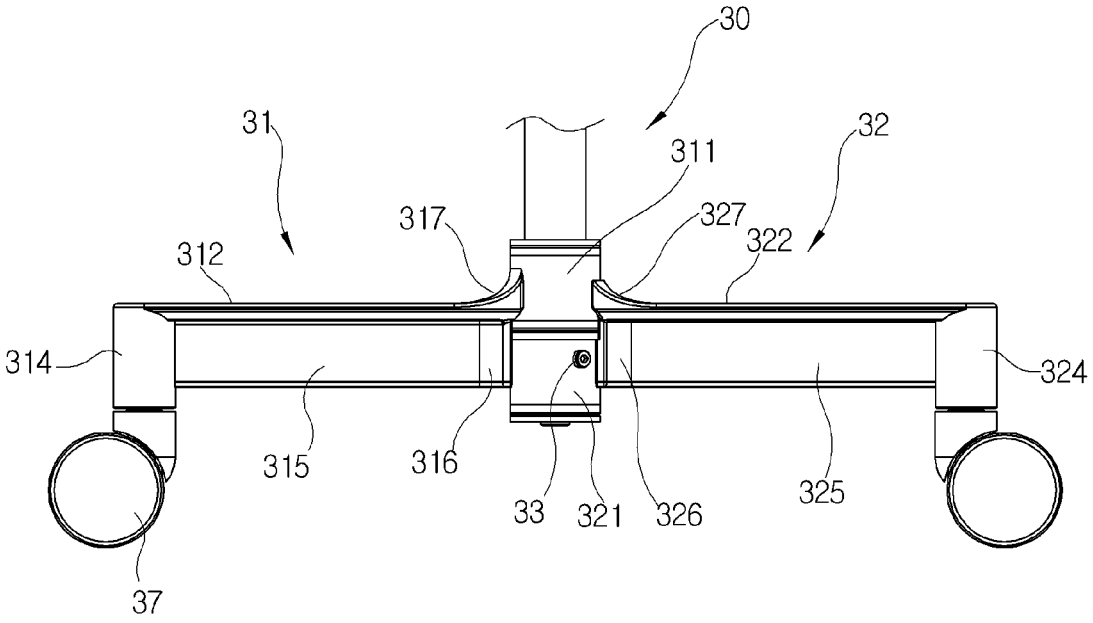
FIG. 9 is a coupled view of FIG. 7.
Figure 10:
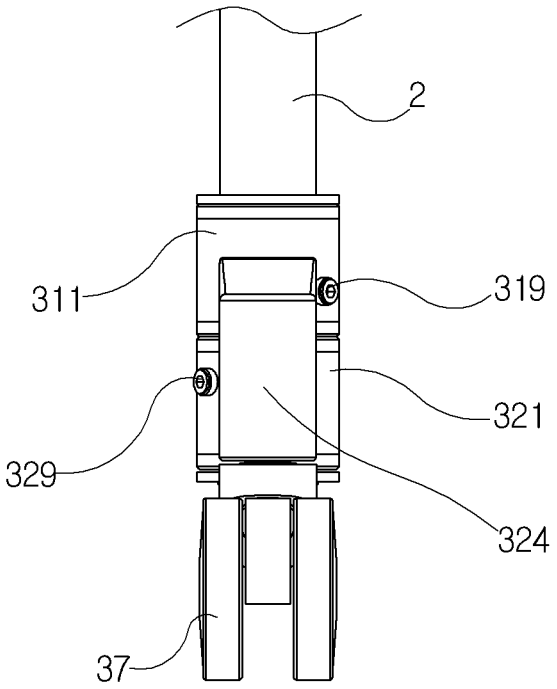
FIG. 10 is a side view of FIG. 9.

FIG. 8 is a coupled cross-sectional view of FIG. 7, FIG. 9 is a coupled view of FIG. 7, and FIG. 10 is a side view of FIG. 9.

As shown in FIGS. 8 to 10, one side of the first body 311 is protrusively formed with a first fastening portion 319 to fasten the set screw 33, whereas one side of the second body 321 is protrusively formed with a second fastening portion 329.

In this case, the first fastening portion 319 makes an angle of approximately 135° with the first extension portion 312 about a center axis of the first body 311, whereas the second fastening portion 329 makes an angle of approximately 45° with the second extension portion 322 about a center axis of the second body 321. That is, an angle between the first and second fastening portions 319 and 329 is approximately 90°, and this allows the angle at which the first and second bases 31 and 32 are rotated with each other to be limited at the minimum angle of 90°, as will be described later in FIG. 12.

In other words, the first and second fastening portions 319 and 329 are protrusively formed from the edges of the first and second through holes 318 and 328 of the respective first and second bodies 311 and 321 to the outside thereof to direct fastening positions of the respective set screws 33. Also, the first and second fastening portions 319 and 329 serve as stoppers to limit the rotational angle of the first base 31 relative to the second base 32. These configuration and operation will be described later.

Figure 11:
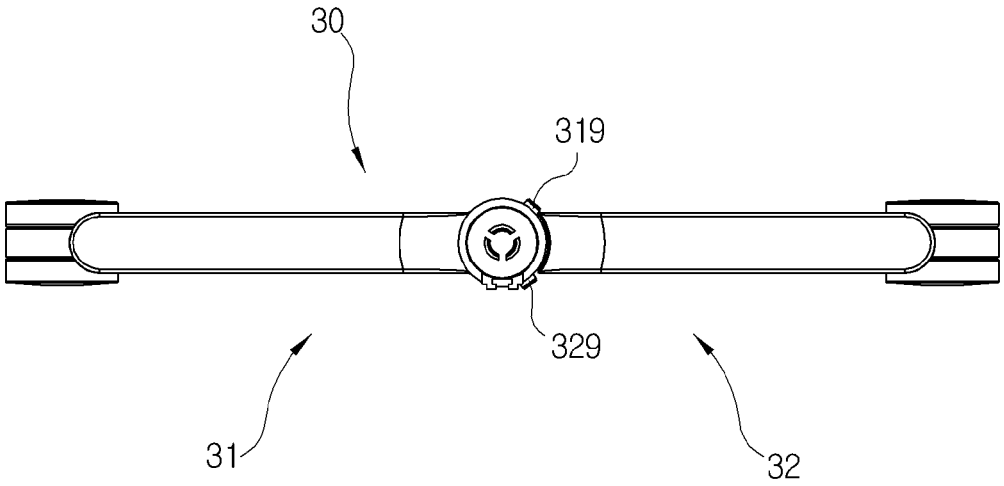
FIG. 11 is an operation state view illustrating an example in which a pair of bases is spread at an angle of 180° in accordance with the third embodiment of the present invention.
Figure 12:
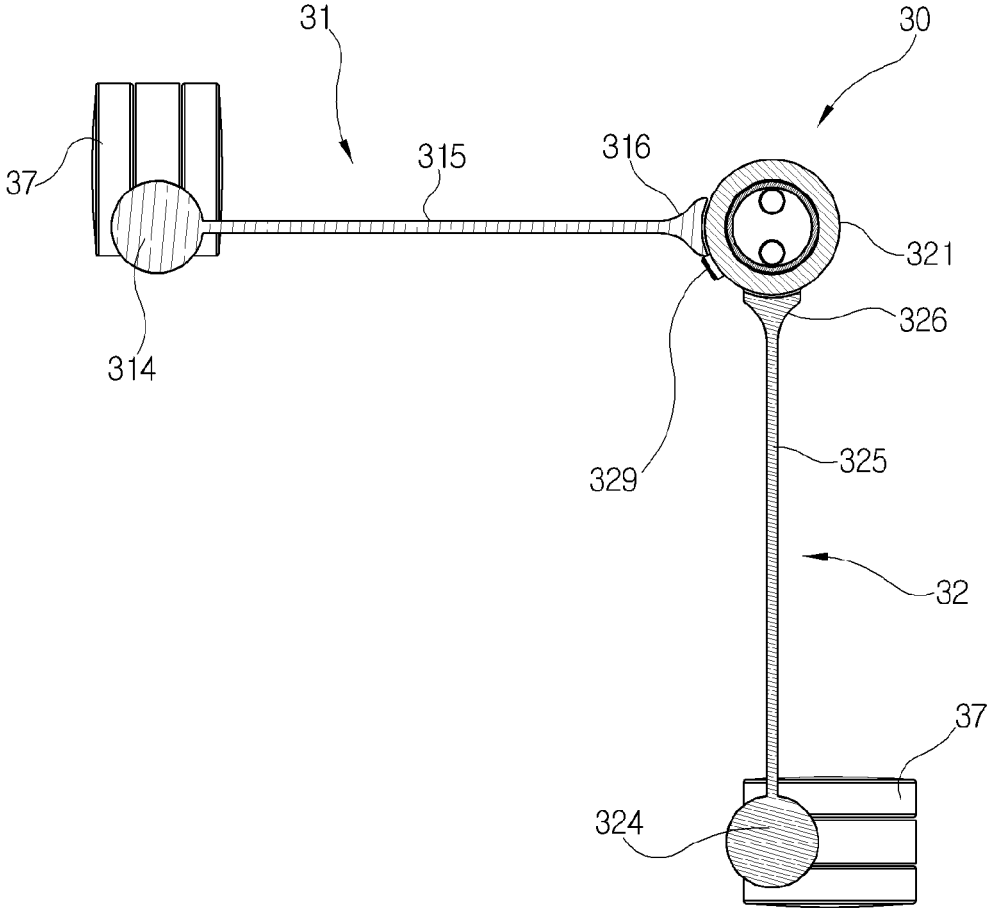
FIG. 12 is an operation state view illustrating an example in which a pair of bases is spread at an angle of 90° in accordance with the third embodiment of the present invention.

FIG. 11 is an operation state view illustrating an example in which a pair of bases is spread at an angle of 180° in accordance with the third embodiment of the present invention, and FIG. 12 is an operation state view illustrating an example in which a pair of bases is spread at an angle of 90° in accordance with the third embodiment of the present invention.

On the basis of the vertical bar 2 in FIG. 11, the first base 31 is illustrated at the left side in the drawing, whereas the second base 32 is illustrated at the right side in the drawing. The first and second fastening portions 319 and 329 are respectively located at both sides of the second base 32 so as to be adjacent to each other.

In this case, when the second base 32 is rotated in a clockwise direction in the drawing in a state where the first base 31 is left as it is, the second base 32 may be rotated until making an angle of 90° with the first base 31 as shown in FIG. 12, such that the second fastening portion 329 of the second base 32 is caught by the first flange portion 316 of the first base 31 so as to prevent further rotation of the second base 32.

On the other hand, when the first base 31 is rotated in a counterclockwise direction in a state where the second base 32 is left as it is, the first flange portion 316 of the first base 31 is caught by the second fastening portion 329 of the second base 32 so as to prevent further rotation of the first base 31. Consequently, the first base 31 makes an angle of 90° with the second base 32.

That is, the rotational angle of the second base 32 relative to the first base 31 may be limited depending on a position of the first fastening portion 319, a shape of the first flange portion 316, a position of the second fastening portion 329, and a shape of the second flange portion 326. Also, the minimum or maximum angle at which the first and second bases 31 and 32 are rotated with each other may be arbitrarily set by changing the above-mentioned position of the first fastening portion 319, etc., on occasion demands.

In this case, the set screws 33 are inserted into and screwed to the first and second fastening portions 319 and 329, respectively, such that the installation portions of the first and second bases 31 and 32 are fixed with respect to the vertical bar 2.

Fourth Embodiment

Figure 13:
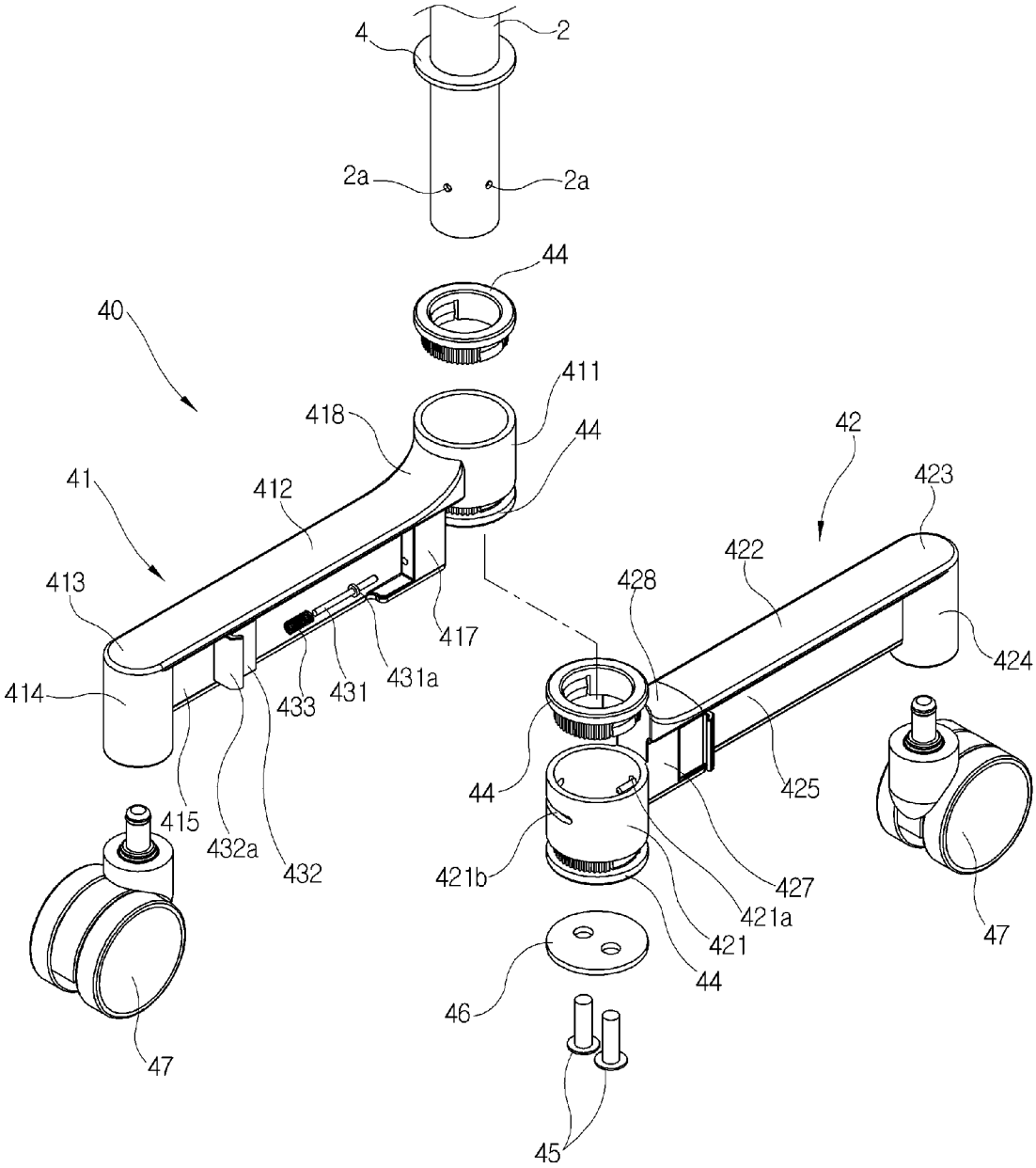
FIG. 13 is an exploded perspective view of a screen base in accordance with a fourth embodiment of the present invention.
Figure 14:
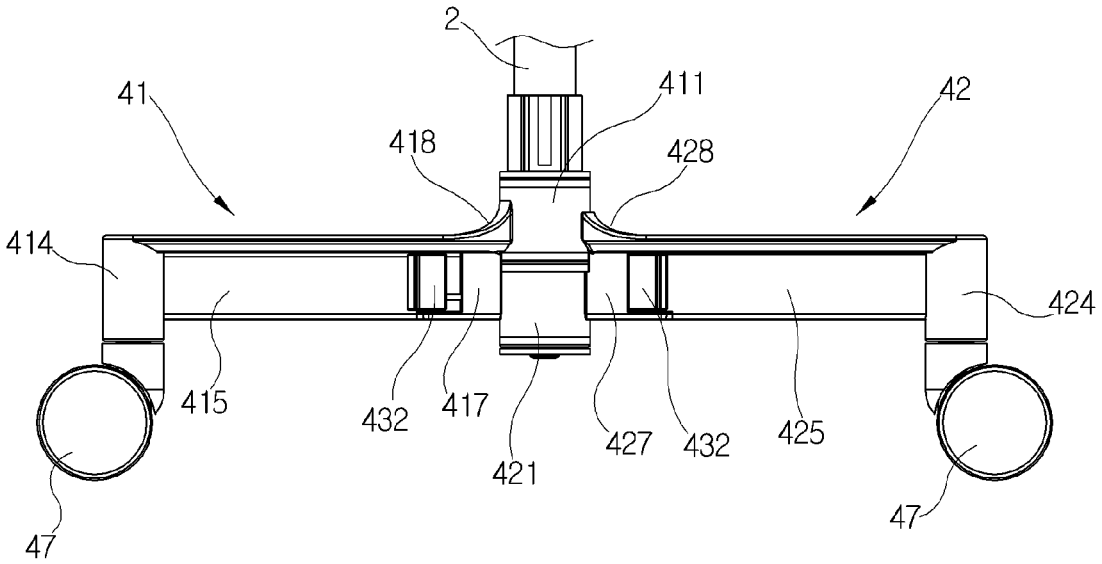
FIG. 14 is a coupled view of FIG. 13.
Figure 15:
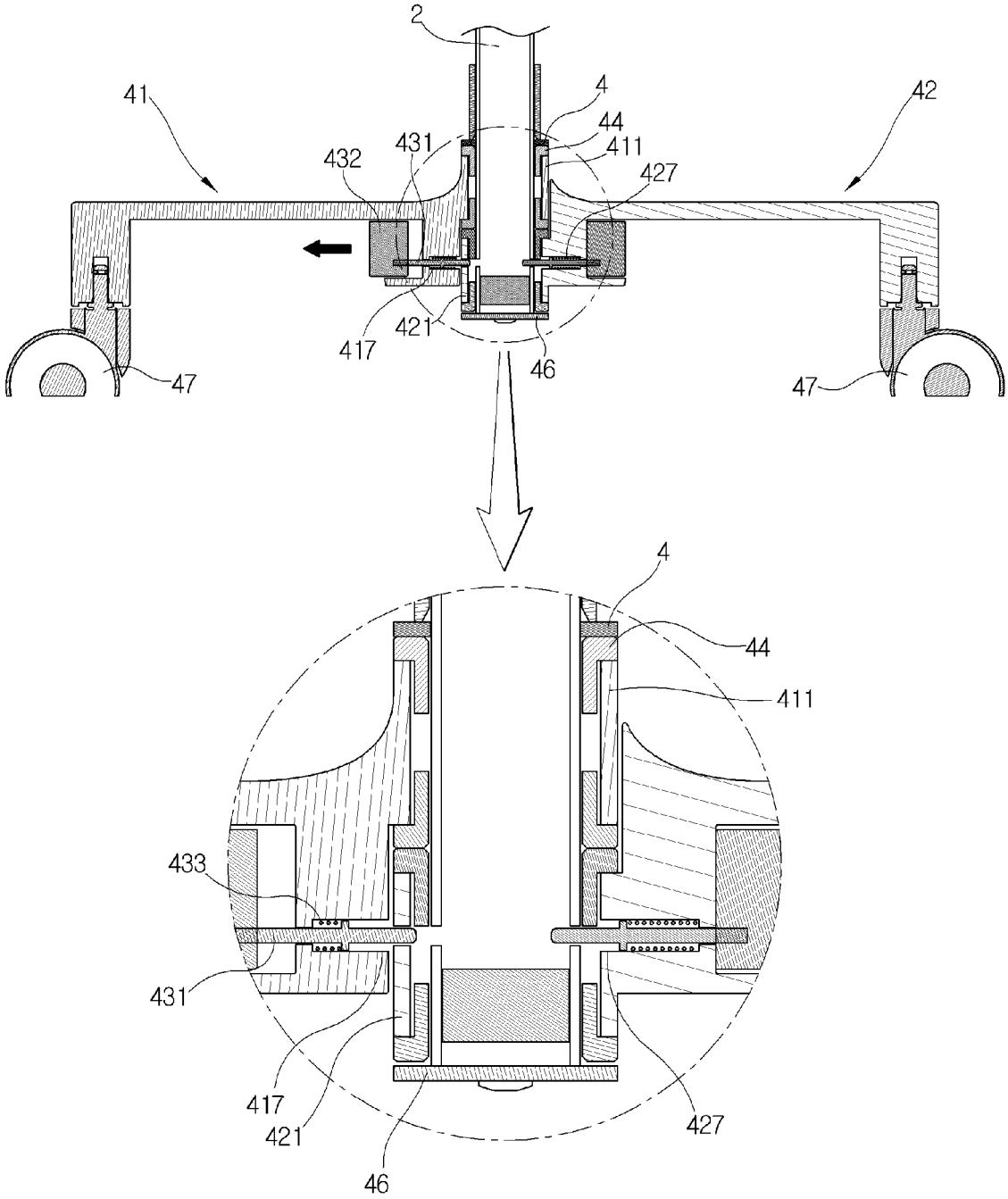
FIG. 15 is a cross-sectional view of FIG. 14.

FIG. 13 is an exploded perspective view of a screen base in accordance with a fourth embodiment of the present invention, FIG. 14 is a coupled view of FIG. 13, and FIG. 15 is a cross-sectional view of FIG. 14.

The screen base, which is designated by reference numeral 40, according to the fourth embodiment of the present invention includes a base which is rotatably coupled to the lower end portion of the vertical bar 2, and a fixing unit to fix the base with respect to the vertical bar 2.

In this case, the base may be constituted of a pair of first base 41 and second base 42. The first base 41 and the second base 42 are rotatably coupled relative to the vertical bar 2 extending to the lower end of the screen, thereby supporting the screen so that the screen does not fall down.

Here, the first base 41 includes a first hollow cylindrical body 411 for inserting the vertical bar 2, and a first extension portion 412 which extends outward of the vertical bar 2 from one side of the first body 411. The first body 411 may be rotated along the outer peripheral surface of the vertical bar 2 in the circumferential direction thereof.

The second base 42 includes a second hollow cylindrical body 421 for inserting the vertical bar 2, and a second extension portion 422 which extends outward of the vertical bar 2 from one side of the second body 421. The second body 421 may be rotated along the outer peripheral surface of the vertical bar 2 in the circumferential direction thereof.

During the assembly of the first and second bases 41 and 42 to the vertical bar 2, the second body 421 is located at a lower end of the first body 411 and the first and second extension portions 412 and 422 are located at the same height as each other. For this reason, the first extension portion 412 may extend outward of the vertical bar 2 from one side of the lower end of the first body 411, and the second extension portion 422 may extend outward of the vertical bar 2 from one side of an upper end of the second body 421.

Accordingly, a user may rotate the first base 41 so that the first base 41 makes a proper angle with respect to the vertical bar 2 in a state of inserting the first body 411 of the first base 41 and the second body 421 of the second base 42 into the outer peripheral surface of the vertical bar 2. The first and second bases 41 and 42 are fixed with respect to the vertical bar 2 by inserting each base pin 431 of the fixing unit to be described later into an associated fixing hole 2*a* of the vertical bar 2.

In this case, the fixing hole 2*a* of the vertical bar 2 may be formed as plural in number on the outer peripheral surface of the vertical bar 2, corresponding to an angle at which the first and second bases 41 and 42 are rotated. For example, the fixing holes 2*a* may be formed at equal intervals of 30° along the circumferential direction of the vertical bar 2.

Here, the vertical bar 2 may have a circular or polygonal cross-section shape, and have a hollow pipe shape in order to attain a reduction in materials and weight. The one or more fixing holes 2*a* are formed to be spaced apart from one another by a predetermined distance along the outer peripheral surface of the vertical bar 2 in the circumferential direction thereof.

The first and second bodies 411 and 421 have a hollow cylindrical shape, and the above-mentioned vertical bar 2 is rotatably coupled to the hollowness of each of the first and second bodies 411 and 421. In this case, in order for the vertical bar 2 and the first and second bodies 411 and 421 to be smoothly rotated relative to one another, the hollowness of each of the first and second bodies 411 and 421 may be provided, at respective upper and lower ends thereof, with bushings 44 which are made of, for example, a plastic material such as polyacetal (POM), and the lower end of the vertical bar 2 may be coupled to a lower end cover 46 using fasteners 45 such as a bolt.

In this case, the first and second extension portions 412 and 422 have a predetermined width, and are formed in a plate shape having a longer length than the width. The first and second extension portions 412 and 422 respectively have ends formed in a rounded shape, and the rounded ends of the first and second extension portions 412 and 422 are respectively formed with a first round portion 413 and a second round portion 423 which have an arc shape.

The first and second round portions 413 and 423 are formed, at respective lower ends thereof, with a first cylindrical support portion 414 and a second cylindrical support portion 424 which are formed to extend downwards from the lower ends thereof. The first and second support portions 414 and 424 may be directly supported on the ground, or be provided, at respective lower ends thereof, with casters 47 as shown in FIGS. 13 and 14 so that the screen is movable.

Furthermore, the first and second extension portions 412 and 422 are formed, at lower ends thereof, with first and second reinforced portions 415 and 425 in downward directions thereof, respectively. The first and second reinforced portions 415 and 425 are respectively formed along longitudinal directions of the first and second extension portions 412 and 422. Each of the first and second reinforced portions 415 and 425 is connected, at one end thereof, to one side of each of the first and second bodies 411 and 421 while being connected, at the other end thereof, to one side of each of the first and second support portions 414 and 424.

In this case, one side of the associated first or second reinforced portion 415 or 425 abutting on each of the first and second bodies 411 and 421 may be formed with an associated first or second flange portion 416 or 426 (see FIG. 16) which has an increasing thickness as going toward each first or second body 411 or 421. The other side of the first or second reinforced portion 415 or 425 is formed with an associated first or second base pin receiving portion 417 or 427 so as to receive each base pin 431 to be described later.

In addition, the first and second extension portions 412 and 422 are formed, at upper sides thereof adjacent to the first and second bodies 411 and 421, with first and second connection portions 418 and 428 which are inclined upwards toward the first and second bodies 411 and 421, respectively. Each of the first and second connection portions 418 and 428 has a curved surface at an upper side thereof, thereby providing an aesthetically external appearance.

Meanwhile, the outer peripheral surface of the vertical bar 2 is protrusively formed with the catch part 4 for serving to limit the insertion distance of the vertical bar 2, and the lower end edge of the catch part 4 is caught and supported by an upper end edge of the bushing 44.

In accordance with the present embodiment, the first and second bases 41 and 42 may be respectively provided with the fixing units to fix the first and second bases 41 and 42 at any rotation position with respect to the vertical bar 2. However, since the fixing units of the respective first and second bases 41 and 42 have the same configuration and operation, the fixing unit of the first base 41 as an example will be described with respect to the configuration and operation thereof below.

The fixing unit of the first base 41 includes the base pin 431 inserted into the fixing hole 2*a* of the vertical bar 2, and a switch member 432 which is coupled to one side of the first reinforced portion 415 so as to be slidable in the longitudinal direction of the first base 41 while the other end of the base pin 431 is coupled to one side of the switch member 432. The base pin 431 may be provided, at one side thereof, with an elastic member 433 to elastically support the base pin 431 toward the vertical bar 2.

Here, the switch member 432 is slidably coupled to one side of the first reinforced portion 415. Although not shown in the drawings, for example, one side of the first reinforced portion 415 is formed with a pair of rails which vertically faces each other and has a "]" shape in cross-section, so that upper and lower edges of the switch member 432 are inserted into and supported by the pair of rails to allow the switch member 432 to be slidable. In this case, one side of the switch member 432 may be protrusively formed with a grasp portion 432*a* to facilitate the grasp of the switch member 432.

In one side of the first reinforced portion 415, the base pin 431 passes through the above-mentioned first base pin receiving portion 417. Subsequently, the base pin 431 is inserted, at one end thereof, into the fixing hole 2*a* of the vertical bar 2 while being coupled, at the other end thereof, to one side of the switch member 432, such that one end of the base pin 431 is inserted into the fixing hole 2*a* of the vertical bar 2 or is released from the inserted state into the fixing hole 2*a* of the vertical bar 2 during movement of the switch member 432 in a left or right direction.

In this case, one side of the base pin 431 is formed with a catch portion 431*a*, and the elastic member 433 such as a coil spring is interposed between the catch portion 431*a* and an inner wall of the first base pin receiving portion 417. Consequently, the base pin 431 is elastically supported toward the vertical bar 2 by the elastic member 433.

Accordingly, when the switch member 432 is moved outward of the vertical bar 2 in a state where the grasp portion 432*a* of the switch member 432 is caught, the base pin 431 is separated from the fixing hole 2*a* of the vertical bar 2 along with compression of the elastic member 433, thereby enabling rotation of the first base 41. On the other hand, when the first base 41 is rotated at a proper angle and then the switch member 432 is released from the caught state, the base pin 431 is moved toward the vertical bar 2 due to the elastic force of the elastic member 433 and the tip of the base pin 431 is inserted into the fixing hole 2*a*. Consequently, the first base 41 may be fixed in position.

Meanwhile, the rotational angle of the second base 42 relative to the first base 41 may be limited by a cutting groove 421*b* which is cut and formed on the outer peripheral surface of the second body 421 in the circumferential direction thereof by a predetermined angle.

That is, as shown in FIG. 13, the second body 421 is formed, at one side thereof, with a through hole 421*a* for inserting the base pin 431 of the second base 42 while being formed, at the other side thereof facing the one side, with the cutting groove 421*b* which is cut by a predetermined angle in the circumferential direction. The base pin 431 of the first base 41 is inserted through the cutting groove 421*b* and is caught by both ends of the cutting groove 421*b* during the rotation of the second base 42 relative to the first base 41, thereby limiting the rotational angle of the second base 42. These configuration and operation will be described below.

Figure 16:
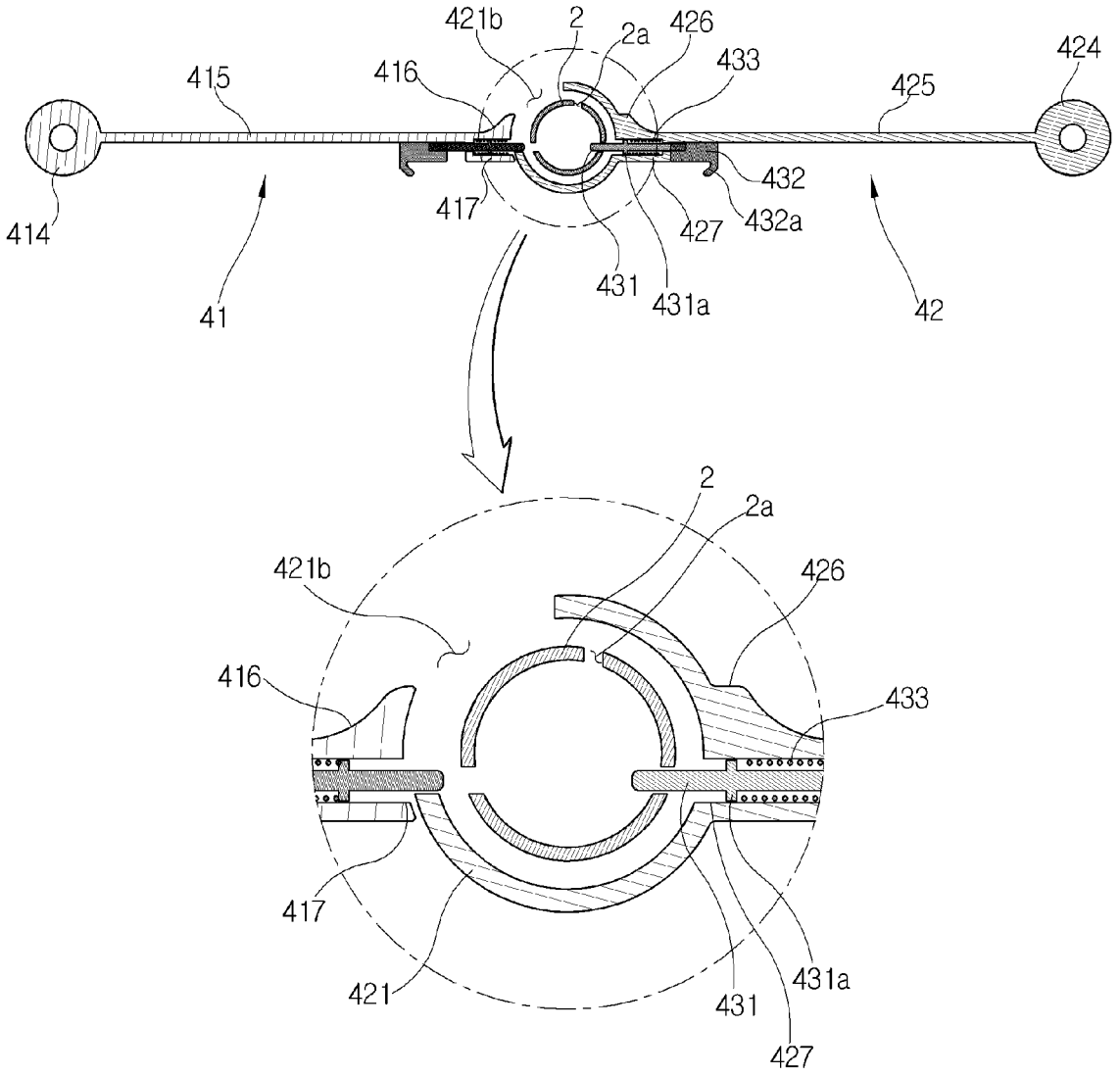
FIG. 16 is an operation state view illustrating an example in which a pair of bases is spread at an angle of 180° in accordance with the fourth embodiment of the present invention.
Figure 17:
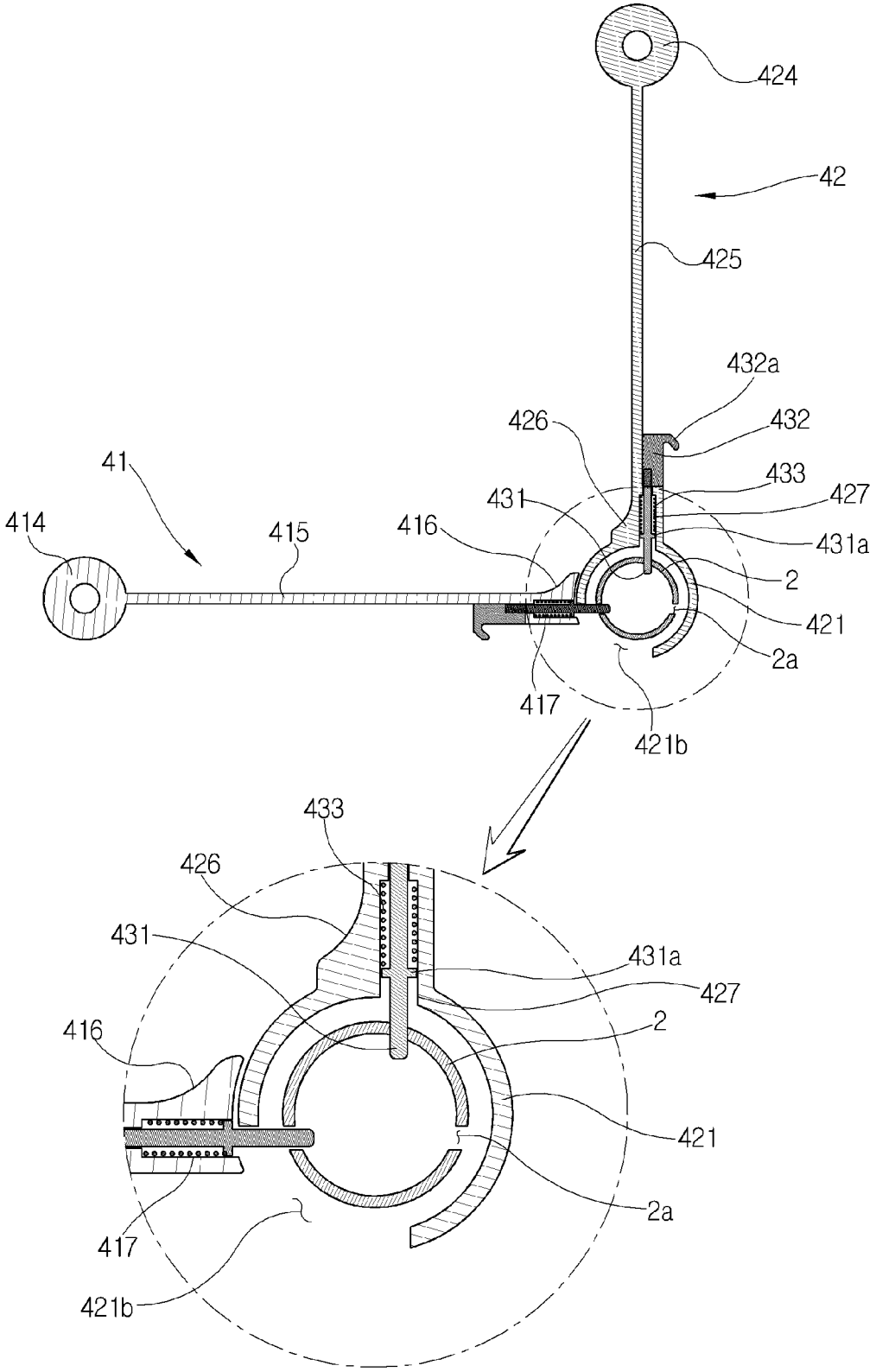
FIG. 17 is an operation state view illustrating an example in which a pair of bases is spread at an angle of 90° in accordance with the fourth embodiment of the present invention.

FIG. 16 is an operation state view illustrating an example in which a pair of bases is spread at an angle of 180° in accordance with the fourth embodiment of the present invention, and FIG. 17 is an operation state view illustrating an example in which a pair of bases is spread at an angle of 90° in accordance with the fourth embodiment of the present invention.

On the basis of the vertical bar 2 in FIG. 16, the first base 41 is illustrated at the left side in the drawing, whereas the second base 42 is illustrated at the right side in the drawing. In a state where the base pin 431 of the first base 41 is inserted into the cutting groove 421*b* of the second body 421 and the base pin 431 of the second base 42 is inserted into the fixing hole 2*a* of the vertical bar 2 via the through hole 421*a* of the second body 421, the first and second bases 41 and 42 are spread at an angle of the 180° with respect to the vertical bar 2.

In this case, when the base pin 431 of the second base 42 is released from the inserted state into the vertical bar 2 and at the same time the second base 42 is rotated in a counterclockwise direction in the drawing in a state where the first base 41 is left as it is, the base pin 431 of the first base 41 is caught by one side of the cutting groove 421*b* of the second body 421 during the rotation of the second body 421 so as to prevent further rotation of the second base 42. Consequently, the first base 41 makes an angle of 90° with the second base 42.

In addition, when the base pin 431 of the first base 41 is released from the inserted state into the vertical bar 2 and at the same time the first base 41 is rotated in a clockwise direction in a state where the second base 42 is left as it is, the first base 41 may be rotated until the base pin 431 of the first base 41 is caught by one side of the cutting groove 421*b* of the second body 421. Consequently, the first base 41 makes an angle of 90° with the second base 42. In this case, the fixing hole 2*a* may also be formed at a position corresponding to the base pin 431 of the rotated first base 41.

That is, the rotational angle of the second base 42 relative to the first base 41 may be limited depending on a shape of the cutting groove 421*b* of the second body 421. Also, the minimum or maximum angle at which the first and second bases 41 and 42 are rotated with each other may be arbitrarily set by changing the length of the cutting groove 421*b* and the position of the fixing hole 2*a*, on occasion demands.

Fifth Embodiment

Figure 18:
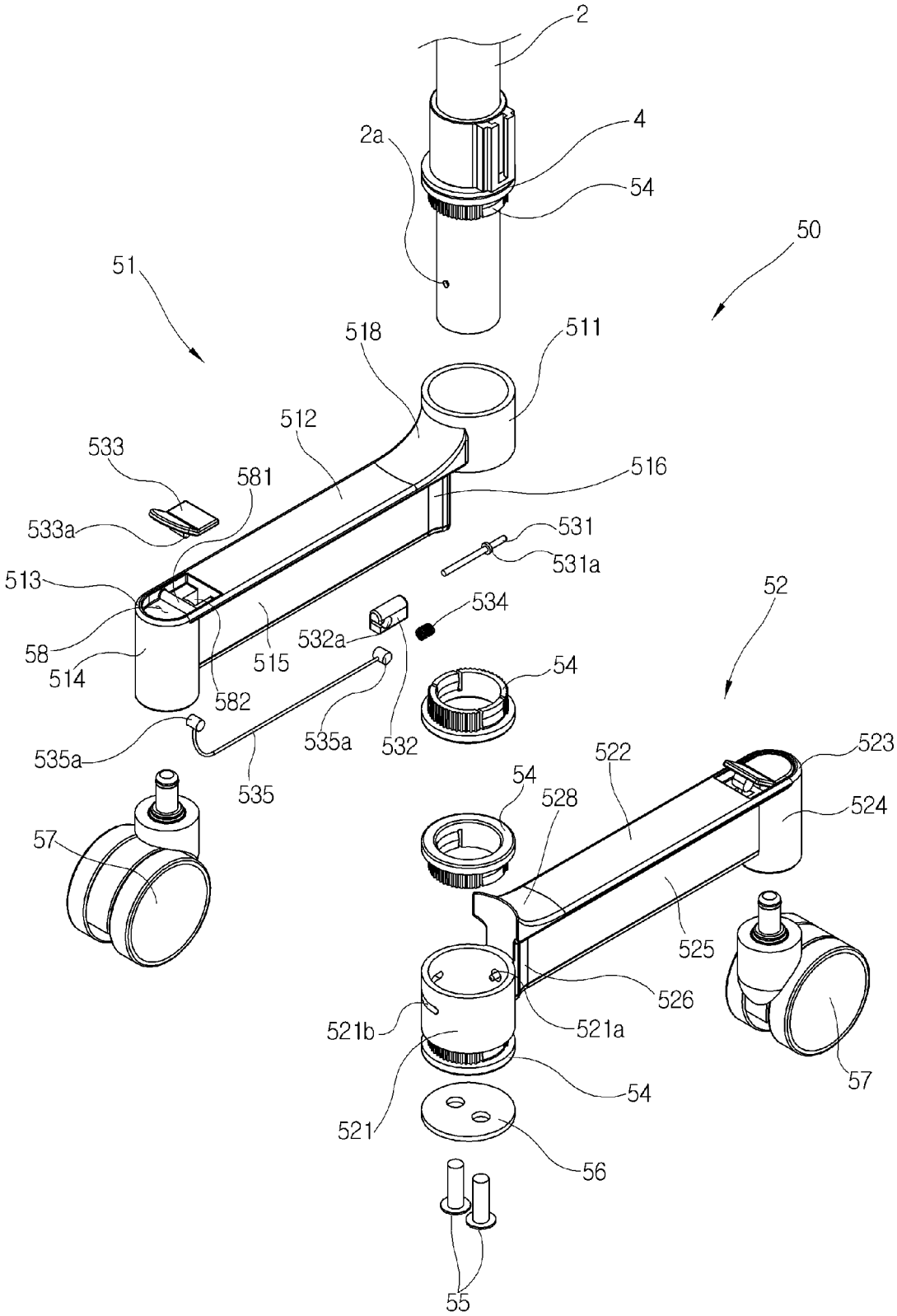
FIG. 18 is an exploded perspective view of a screen base in accordance with a fifth embodiment of the present invention.
Figure 19:
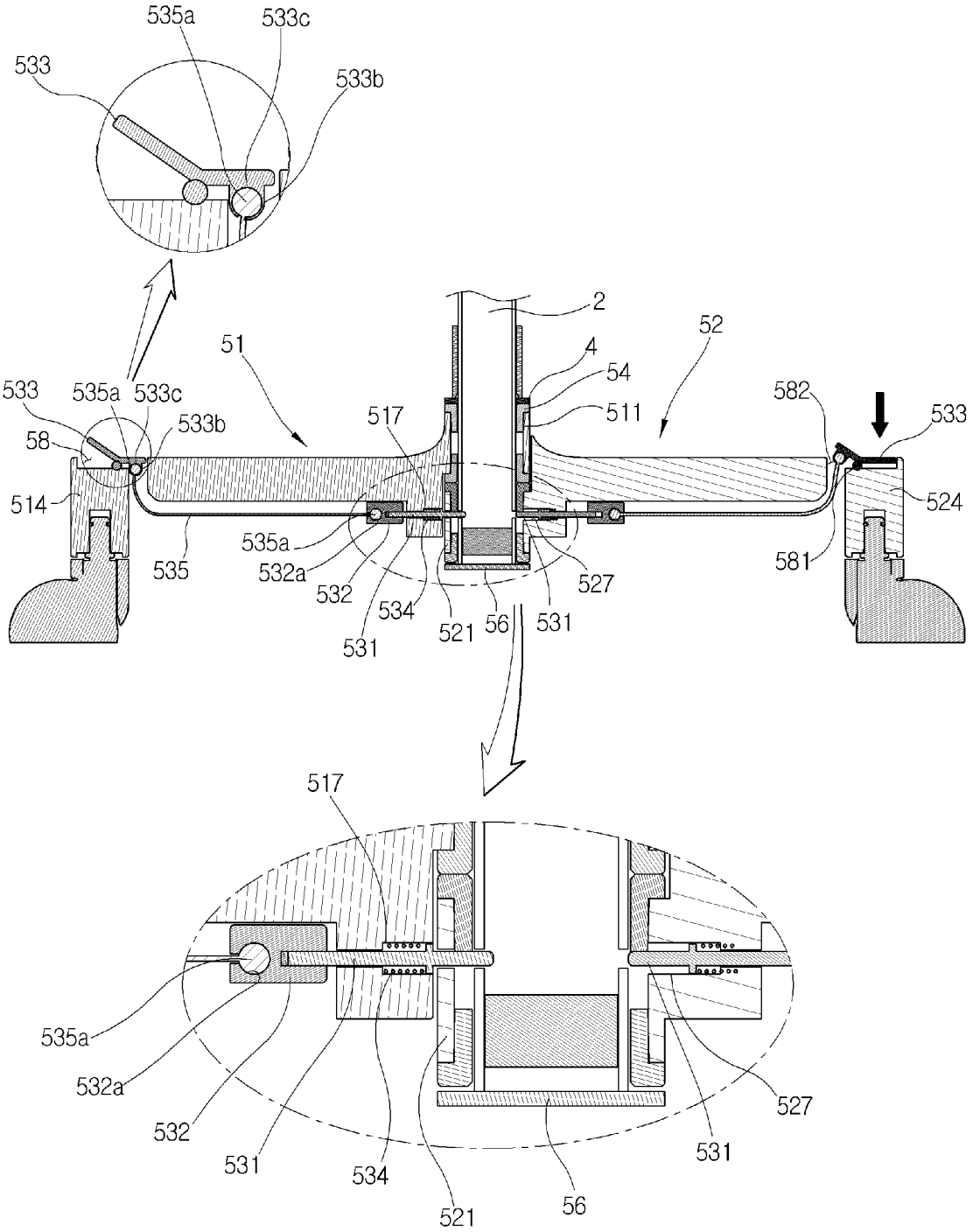
FIG. 19 is a coupled cross-sectional view of FIG. 18.

FIG. 18 is an exploded perspective view of a screen base in accordance with a fifth embodiment of the present invention, and FIG. 19 is a coupled cross-sectional view of FIG. 18.

The screen base, which is designated by reference numeral 50, according to the fifth embodiment of the present invention is entirely similar to the screen base of the above-mentioned fourth embodiment. However, there is a difference in the configuration of a fixing unit in which foot switch members 533 are respectively provided at upper sides of first and second extension portions 512 and 522, base pins 531 are installed to be slidable within respective first and second reinforced portions 515 and 525, each foot switch member 533 and the associated base pin 531 are connected by a wire cable 535, and the like. Therefore, no description with respect to configurations which repeat or are similar to the above-mentioned fourth embodiment will be given in more detail.

The screen base 50 according to the fifth embodiment of the present invention includes a base which is rotatably coupled to the lower end portion of the vertical bar 2, and a fixing unit to fix the base with respect to the vertical bar 2.

In this case, the base includes a first base 51 and a second base 52 which are rotatably coupled relative to the vertical bar 2.

Here, the first base 51 includes a first hollow cylindrical body 511 for inserting the vertical bar 2, and a first extension portion 512 which extends outward of the vertical bar 2 from one side of the first body 511. The first body 511 may be rotated along the outer peripheral surface of the vertical bar 2 in the circumferential direction thereof.

The second base 52 includes a second hollow cylindrical body 521 for inserting the vertical bar 2, and a second extension portion 522 which extends outward of the vertical bar 2 from one side of the second body 521. The second body 521 may be rotated along the outer peripheral surface of the vertical bar 2 in the circumferential direction thereof.

During the assembly of the first and second bases 51 and 52 to the vertical bar 2, the second body 521 is located at a lower end of the first body 511 and the first and second extension portions 512 and 522 are located at the same height as each other. For this reason, the first extension portion 512 may extend outward of the vertical bar 2 from one side of the lower end of the first body 511, and the second extension portion 522 may extend outward of the vertical bar 2 from one side of an upper end of the second body 521.

Accordingly, a user may rotate the first base 51 so that the first base 51 makes a proper angle with respect to the vertical bar 2 in a state of inserting the first body 511 of the first base 51 and the second body 521 of the second base 52 into the outer peripheral surface of the vertical bar 2. The first and second bases 51 and 52 are fixed with respect to the vertical bar 2 by inserting each base pin 531 of the fixing unit to be described later into an associated fixing hole 2*a* of the vertical bar 2.

Here, the vertical bar 2 may have a circular or polygonal cross-section shape, and have a hollow pipe shape in order to attain a reduction in materials and weight. The one or more fixing holes 2*a* are formed to be spaced apart from one another by a predetermined distance along the outer peripheral surface of the vertical bar 2 in the circumferential direction thereof.

In this case, the fixing hole 2*a* may be formed as plural in number on the outer peripheral surface of the vertical bar 2, corresponding to an angle at which the first and second bases 51 and 52 are rotated. For example, the fixing holes 2*a* may be formed at equal intervals of 30° along the circumferential direction of the vertical bar 2.

The first and second bodies 511 and 521 have a hollow cylindrical shape, and the above-mentioned vertical bar 2 is rotatably coupled to the hollowness of each of the first and second bodies 511 and 521. In this case, in order for the vertical bar 2 and the first and second bodies 511 and 521 to be smoothly rotated relative to one another, the hollowness of each of the first and second bodies 511 and 521 may be provided, at respective upper and lower ends thereof, with bushings 54 which are made of, for example, a plastic material such as polyacetal (POM), and the lower end of the vertical bar 2 may be coupled to a lower end cover 56 using fasteners 55 such as a bolt.

In this case, the first and second extension portions 512 and 522 have a predetermined width, and are formed in a plate shape having a longer length than the width. The first and second extension portions 512 and 522 respectively have ends formed in a rounded shape, and the rounded ends of the first and second extension portions 512 and 522 are respectively formed with a first round portion 513 and a second round portion 523 which have an arc shape.

The ends of the first and second extension portions 512 and 522, namely, upper sides of the first and second round portions 513 and 523 are respectively formed with coupling grooves 58 for coupling the foot switch members 533 to be described later. In this case, each coupling groove 58 is formed, at a center thereof, with a hinge shaft 581 in a width direction thereof, and one side of the hinge shaft 581 is penetratively formed with a connection hole 582 which is communicated with an associated operation space portion 59 of each of first and second reinforce portions 515 and 525 to be described later.

The first and second round portions 513 and 523 are formed, at respective lower ends thereof, with a first cylindrical support portion 514 and a second cylindrical support portion 524 which are formed to extend downwards from the lower ends thereof. The first and second support portions 514 and 524 may be directly supported on the ground, or be provided, at respective lower ends thereof, with casters 57 as shown in FIGS. 18 and 19 so that the screen is movable.

Furthermore, the first and second extension portions 512 and 522 are formed, at lower ends thereof, with the first and second reinforced portions 515 and 525 in downward directions thereof, respectively. The first and second reinforced portions 515 and 525 are respectively formed along longitudinal directions of the first and second extension portions 512 and 522. Each of the first and second reinforced portions 515 and 525 is connected, at one end thereof, to one side of each of the first and second bodies 511 and 521 while being connected, at the other end thereof, to one side of each of the first and second support portions 514 and 524.

In this case, one end of the associated first or second reinforced portion 515 or 525 abutting on each of the first and second bodies 511 and 521 is formed with an associated first or second flange portion 516 or 526 which has an increasing thickness as going toward each first or second body 511 or 521. Each of the first and second flange portions 516 and 526 is formed therein with an associated first or second base pin receiving portion 517 or 527 so as to receive the base pin 531 to be described later.

In this case, each of the first and second reinforced portions 515 and 525 is formed therein with the operation space portion 59 for receiving the base pin 531, pin connector 532, and wire cable 535 to be described later. The operation space portion 59 is communicated, at one side of an upper end thereof, with the above-mentioned connection hole 582, and the wire cable 535 in the operation space portion 59 is connected to the associated foot switch member 533 through the connection hole 582.

In addition, the first and second extension portions 512 and 522 are formed, at upper sides thereof adjacent to the first and second bodies 511 and 521, with first and second connection portions 518 and 528 which are inclined upwards toward the first and second bodies 511 and 521, respectively. Each of the first and second connection portions 518 and 528 has a curved surface at an upper side thereof, thereby providing an aesthetically external appearance.

Meanwhile, the outer peripheral surface of the vertical bar 2 is protrusively formed with the catch part 4 for serving to limit the insertion distance of the vertical bar 2, and the lower end edge of the catch part 4 is caught and supported by an upper end edge of the bushing 54.

In accordance with the present embodiment, the first and second bases 51 and 52 may be respectively provided with the fixing units to fix the first and second bases 51 and 52 at any rotation position with respect to the vertical bar 2. However, since the fixing units of the respective first and second bases 51 and 52 have the same configuration and operation, the fixing unit of the first base 51 as an example will be described with respect to the configuration and operation thereof below.

The fixing unit of the first base 51 includes the base pin 531 inserted into the fixing hole 2*a* of the vertical bar 2, the pin connector 532 which is installed in the operation space portion 59 within the first reinforced portion 515 so as to be slidable in the longitudinal direction of the first reinforced portion 515 while the other end of the base pin 531 is coupled to one side of the pin connector 532, the foot switch member 533 which is hinge-coupled to the upper side of the end of the first extension portion 512 so as to be rotatable in an upward and downward direction, and the wire cable 535 to connect the lower end of the foot switch member 533 and the other side of the pin connector 532. The base pin 531 may be provided, at one side thereof, with an elastic member 534 to elastically support the base pin 531 toward the vertical bar 2.

Here, the pin connector 532 has a hexahedral block shape in entirety thereof, and is installed in the operation space portion 59 within the first reinforced portion 515 so as to be slidable in a left and right direction. The pin connector is formed, at one side thereof, with a fitting groove 532*a* to fit an associated connection port 535*a* of the wire cable 535 to be described later.

In one side of the operation space portion 59, the base pin 531 is inserted toward the first base pin receiving portion 517, and is then inserted, at one end thereof, into the fixing hole 2*a* of the vertical bar 2.

In this case, the other end of the base pin 531 is coupled to one side of the pin connector 532, such that one end of the base pin 531 is inserted into the fixing hole 2*a* of the vertical bar 2 or is released from the inserted state into the fixing hole 2*a* of the vertical bar 2 during movement of the pin connector 532 in the left or right direction.

In this case, one side of the base pin 531 is formed with a catch portion 531*a*, and the elastic member 534 such as a coil spring is interposed between the catch portion 531*a* and an inner wall of the first base pin receiving portion 517. Consequently, the base pin 531 is elastically supported toward the vertical bar 2 by the elastic member 534.

The fastening and unfastening of the base pin 531 depending on the movement of the pin connector 532 in the left and right directions are attained by an operation of the foot switch member 533 connected to the pin connector 532 via the wire cable 535.

In this case, the foot switch member 533 has a bent plate shape so that both ends of the foot switch member 533 are made at a predetermined angle therebetween. The foot switch member 533 has one end formed in a rounded shape as an arc form corresponding to the shape of the first or second round portion 513 or 515. The lower end of the foot switch member 533 is formed, at a center thereof, with a hinge shaft receiving portion 533*a* to couple the hinge shaft 581 of the coupling groove 58 while being protrusively formed, at one side thereof, with a fitting portion 533*b* to form a fitting hole 533*c*.

Both ends of the wire cable 535 are provided with the connection ports 535*a* having a cylindrical shape, and the connection ports 535*a* are fitted to the fitting groove 532*a* of the pin connector 532 and the fitting hole 533*c* of the foot switch member 533, respectively.

Accordingly, as shown in FIG. 19, when the rounded one end of the foot switch member 533 is pressed or pushed with the foot or hand, the wire cable 535 fitted to the fitting portion 533*b* is pulled while the other end of the foot switch member 533 is rotated upwards about the hinge shaft receiving portion 533*a*. Subsequently, the base pin 531 is separated from the fixing hole 2*a* of the vertical bar 2 while the pin connector 532 is moved outward of the vertical bar 2, thereby enabling rotation of the first base 51.

In addition, when the first base 51 is rotated at a proper angle and then the other end of the foot switch member 533 is pressed or pushed with the foot or hand, the base pin 531 is moved toward the vertical bar 2 due to the elastic force of the elastic member 534 while the wire cable 535 is released and the tip of the base pin 531 is inserted into the fixing hole 2*a*. Consequently, the first base 51 may be fixed in position.

Meanwhile, the rotational angle of the second base 52 relative to the first base 51 may be limited by a cutting groove 521*b* which is cut and formed on the outer peripheral surface of the second body 521 in the circumferential direction thereof by a predetermined angle.

That is, as shown in FIG. 18, the second body 521 is formed, at one side thereof, with a through hole 521*a* for inserting the base pin 531 of the second base 52 while being formed, at the other side thereof facing the one side, with the cutting groove 521*b* which is cut by a predetermined angle in the circumferential direction. The base pin 531 of the first base 51 is inserted through the cutting groove 521*b* and is caught by both ends of the cutting groove 521*b* during the rotation of the second base 52 relative to the first base 51, thereby limiting the rotational angle of the second base 52. These configuration and operation will be described below.

Figure 20:
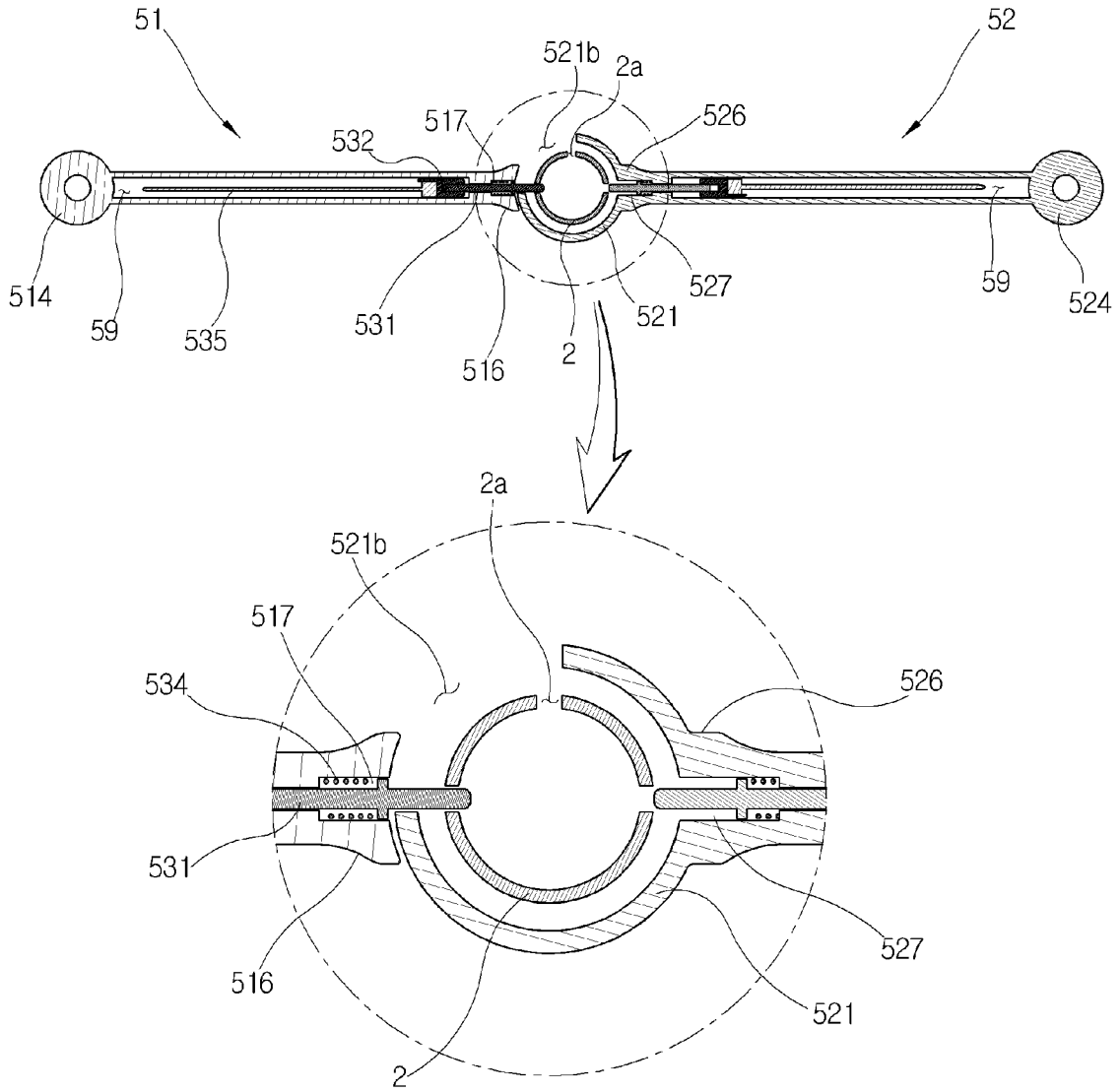
FIG. 20 is an operation state view illustrating an example in which a pair of bases is spread at an angle of 180° in accordance with the fifth embodiment of the present invention.
Figure 21:
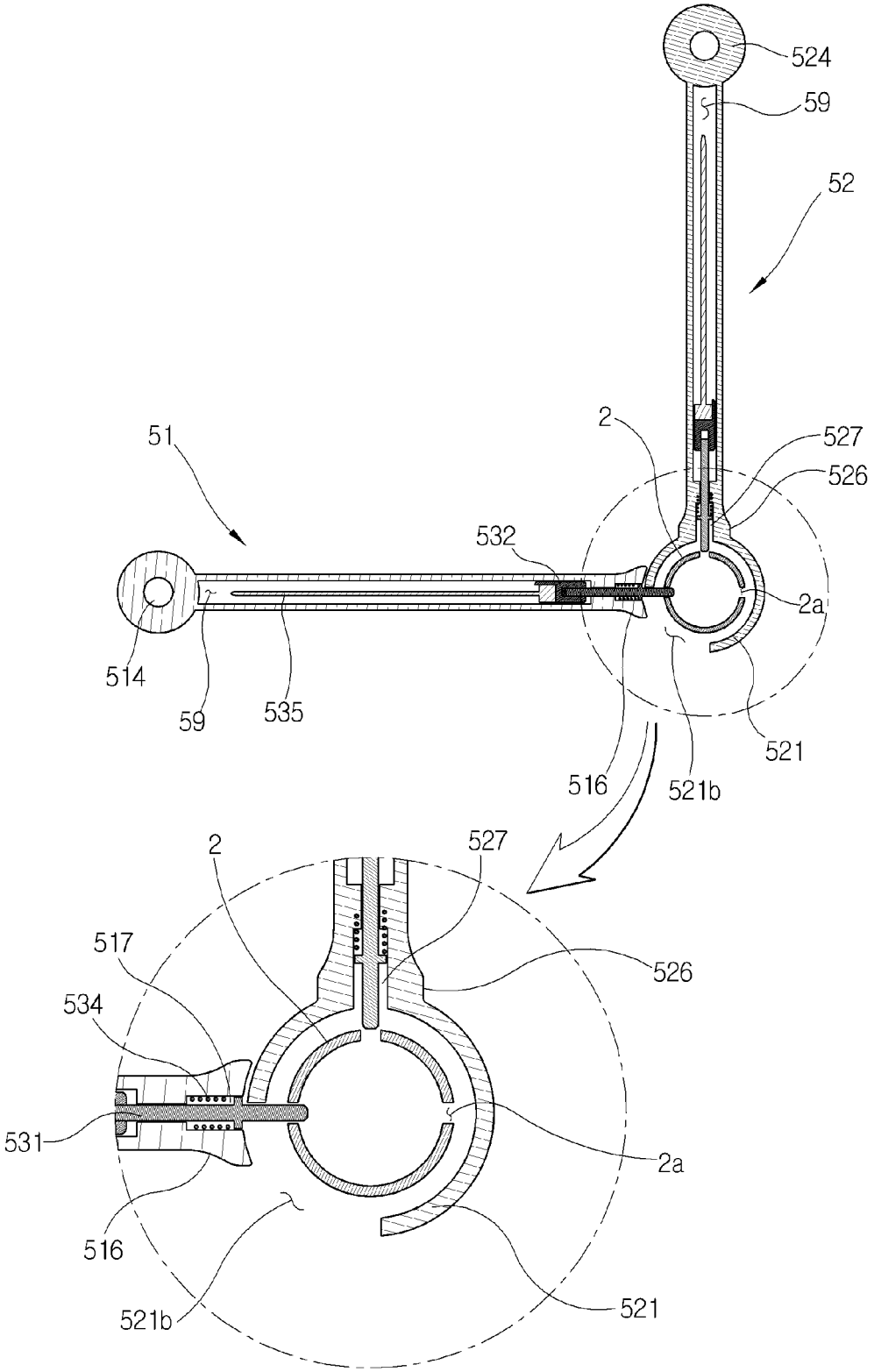
FIG. 21 is an operation state view illustrating an example in which a pair of bases is spread at an angle of 90° in accordance with the fifth embodiment of the present invention.

FIG. 20 is an operation state view illustrating an example in which a pair of bases is spread at an angle of 180° in accordance with the fifth embodiment of the present invention, and FIG. 21 is an operation state view illustrating an example in which a pair of bases is spread at an angle of 90° in accordance with the fifth embodiment of the present invention.

On the basis of the vertical bar 2 in FIG. 20, the first base 51 is illustrated at the left side in the drawing, whereas the second base 52 is illustrated at the right side in the drawing. In a state where the base pin 531 of the first base 51 is inserted into the fixing hole 2*a* of the vertical bar 2 via the cutting groove 521*b* of the second body 521 and the base pin 531 of the second base 52 is inserted into the through hole 521*a* of the second body 521, the first and second bases 51 and 52 are spread at an angle of the 180° with respect to the vertical bar 2.

In this case, when the second base 52 is rotated in a counterclockwise direction in the drawing in a state where the first base 51 is left as it is, the second base 52 may be rotated until making an angle of 90° with the first base 51 during the rotation of the second body 521 as shown in FIG. 21, such that the base pin 531 of the first base 51 is caught by one side of the cutting groove 521*b* of the second body 521 so as to prevent further rotation of the second base 52.

In addition, when the base pin 531 of the first base 51 is released from the inserted state into the vertical bar 2 and then the first base 51 is rotated in a clockwise direction in a state where the second base 52 is left as it is, the first base 51 may be rotated until the base pin 531 of the first base 51 is caught by one side of the cutting groove 521*b* of the second body 521. Consequently, the first base 51 makes an angle of 90° with the second base 52.

That is, the rotational angle of the second base 52 relative to the first base 51 may be limited depending on a shape of the cutting groove 521*b* of the second body 521. Also, the minimum or maximum angle at which the first and second bases

51 and 52 are rotated with each other may be arbitrarily set by changing the shape of the cutting groove 521*b* of the second body 521, on occasion demands.

As is apparent from the above description, in accordance with a screen base according to exemplary embodiment of the present invention, since at least one base is rotatably coupled to a vertical bar which extends to a lower end of a screen, it may be possible to clean up an external appearance of the screen during installation thereof by adjusting an installation angle of the base with respect to the vertical bar.

In addition, in accordance with the screen base, it may be possible to easily fix the base to a proper position using a fastening member such as a set screw or a base pin while adjusting the installation angle of the base with respect to the vertical bar, and to fix the one or more bases while adjusting an angle between the bases. Therefore, the screen base may satisfy a consumer's aesthetic sense while securing a support function of the screen during the installation thereof, thereby enabling an increase in product competitiveness.

While the present invention has been described with respect to the specific embodiments, it will be apparent to those skilled in the art that various changes and modifications may be made without departing from the spirit and scope of the invention as defined in the following claims.

What is claimed is:

1. A screen base which is coupled to a vertical bar extending to a lower end of a screen and supports the screen, the screen base comprising:

a base comprising a body which has a hollow shape and is rotatably coupled to the vertical bar, and an extension portion which is formed to extend outward of the vertical bar from the body; and a fixing unit to fix the body with respect to the vertical bar, wherein the base comprises:

a first base comprising a first body which has a hollow shape and is rotatably coupled to the vertical bar, and a first extension portion which is formed to extend outward of the vertical bar from the first body; and a second base comprising a second body which has a hollow shape and is coupled to a lower end of the first body, and a second extension portion which extends outward of the vertical bar from the second body and is formed at a height corresponding to the first extension portion.

2. The screen base according to claim 1, wherein the hollowness of the first or second body is provided with a bushing, the fixing unit is a set screw which passes through and is inserted into one side of an outer peripheral surface of the first or second body, and a rotational friction force of the first or second body is adjusted with respect to the vertical bar by the set screw.

3. The screen base according to claim 1, wherein:

the first body is protrusively formed, at one side thereof, with a first fastening portion to fasten the fixing unit;

the second body is protrusively formed, at one side thereof, with a second fastening portion; and the first and second fastening portions allow a rotational angle of the second base relative to the first base to be limited.

4. The screen base according to claim 1, wherein the fixing unit comprises:

a base pin of which one end is inserted into a fixing hole of the vertical bar; and a switch member which is slidable in a longitudinal direction of the first or second base, the other end of the base pin being coupled to one side of the switch member.

5. The screen base according to claim 1, wherein the fixing unit comprises:

a base pin of which one end is inserted into a fixing hole of the vertical bar;

a pin connector which is slidable in a longitudinal direction of the first or second base, the other end of the base pin being coupled to one side of the pin connector;

a foot switch member which is hinge-coupled to an upper side of the first or second base so as to be rotatable in an upward and downward direction; and a wire cable to connect a lower end of the foot switch member and the other side of the pin connector.

6. The screen base according to claim 4, wherein the fixing unit further comprises an elastic member to elastically support the base pin toward the vertical bar.

7. The screen base according to claim 1, wherein the second body is formed, at one side thereof, with a through hole while being formed, at the other end thereof, with a cutting groove which is cut by a predetermined angle in a circumferential direction thereof, and a rotational angle of the first base relative to the second base is limited by a base pin of the first base which is inserted into the cutting groove.

8. The screen base according to claim 5, wherein the fixing unit further comprises anelastic member to elastically support the base pin toward the vertical bar.

* * * * *